US009936729B2

(12) United States Patent
Garcia et al.

(10) Patent No.: US 9,936,729 B2
(45) Date of Patent: Apr. 10, 2018

(54) PACKAGE FOR A TOBACCO-CONTAINING MATERIAL AND RELATED PACKAGING METHOD

(71) Applicant: R.J. Reynolds Tobacco Company, Winstom-Salem, NC (US)

(72) Inventors: Ercilia Hernandez Garcia, Clayton, NC (US); Percy D. Phillips, Pfafftown, NC (US); Bruce Alan Bengtsson, Winston-Salem, NC (US); James William Rogers, Winston-Salem, NC (US); Craig Demarest, Oakridge, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 14/979,999

(22) Filed: Dec. 28, 2015

(65) Prior Publication Data

US 2016/0106150 A1 Apr. 21, 2016

Related U.S. Application Data

(63) Continuation-in-part of application No. 14/515,598, filed on Oct. 16, 2014.

(51) Int. Cl.
*A24F 23/00* (2006.01)
*B65B 7/28* (2006.01)
(Continued)

(52) U.S. Cl.
CPC ..... *A24F 23/00* (2013.01); *B65B 7/28* (2013.01); *B65B 29/00* (2013.01); *B65D 81/26* (2013.01)

(58) Field of Classification Search
CPC ..... A24F 23/00; A24F 23/02; A24F 23/04; B65D 25/14; B65D 81/26
(Continued)

(56) References Cited

U.S. PATENT DOCUMENTS 1,980,913 A * 11/1934 Arthur Doll Jacob B65D 85/12 206/273
2,470,372 A 5/1944 Roth
(Continued)

FOREIGN PATENT DOCUMENTS

EP 2 454 953 5/2012
GB 461372 2/1937
(Continued)

OTHER PUBLICATIONS

Plitek; PLI-VALV® Package Degassing System; One-Way Degassing Valves; 1 page; website visited Nov. 4, 2014. http://www.plitek.com/products/package-degassing-system.asp.
(Continued)

*Primary Examiner* — Steven A. Reynolds
(74) *Attorney, Agent, or Firm* — Womble Bond Dickinson (US) LLP

(57) ABSTRACT

A package that may be employed to store a tobacco-containing material is provided. The package may include a container including a body portion and a cover configured to engage the body portion. The body portion may define an internal space therein configured to receive a product. An internal surface of one or both of the body portion and the cover may include a wood liner. The wood liner may be a wood veneer.

8 Claims, 16 Drawing Sheets

(51) Int. Cl.
*B65D 81/26* (2006.01)
*B65B 29/00* (2006.01)

(58) Field of Classification Search
USPC ..... 206/242, 265, 204
See application file for complete search history.

(56) References Cited

U.S. PATENT DOCUMENTS

| | | | | |
|---|---|---|---|---|
| D150,575 | S | 8/1948 | Jay | |
| D153,670 | S | 5/1949 | Derham | |
| D157,538 | S | 2/1950 | Rossi | |
| 2,854,996 | A | 10/1958 | Hughes | |
| 3,291,150 | A | 12/1966 | Ricker | |
| 4,098,421 | A | 7/1978 | Foster | |
| 4,190,170 | A | 2/1980 | Boyd | |
| 5,356,518 | A | 10/1994 | Kelley et al. | |
| 5,556,579 | A | 9/1996 | Newman | |
| 6,216,859 | B1 * | 4/2001 | Manservigi | B65D 75/28 206/245 |
| 7,048,975 | B1 | 5/2006 | Tojo et al. | |
| 7,077,933 | B2 | 7/2006 | Otani et al. | |
| 7,178,555 | B2 | 2/2007 | Engel et al. | |
| 7,328,543 | B2 | 2/2008 | Hoffman et al. | |
| 7,472,524 | B2 | 1/2009 | Hoffman et al. | |
| 7,490,623 | B2 | 2/2009 | Rypstra | |
| 7,611,557 | B2 | 11/2009 | Hoffman | |
| 7,637,283 | B2 | 12/2009 | Hoffman | |
| 7,798,319 | B1 | 9/2010 | Bried et al. | |
| 8,082,644 | B2 | 12/2011 | Hoffman et al. | |
| D658,377 | S | 5/2012 | Corwin et al. | |
| 8,205,415 | B2 | 6/2012 | Sagy et al. | |
| 8,215,482 | B2 | 7/2012 | Cronin et al. | |
| D673,848 | S | 1/2013 | Bailey et al. | |
| D674,688 | S | 1/2013 | Loftin et al. | |
| D675,516 | S | 2/2013 | Horton et al. | |
| 8,458,996 | B2 * | 6/2013 | Bried | A24F 23/00 53/129.1 |
| 8,522,926 | B2 | 9/2013 | Hoffman et al. | |
| D690,588 | S | 10/2013 | Pipes et al. | |
| D692,298 | S | 10/2013 | Pipes et al. | |
| 8,602,210 | B2 * | 12/2013 | Milner | A24F 15/12 131/250 |
| 8,636,034 | B2 | 1/2014 | Hoffman et al. | |
| D704,050 | S | 5/2014 | Pipes et al. | |
| 8,910,781 | B2 | 12/2014 | Pipes et al. | |
| 2004/0096552 | A1 | 5/2004 | Thomas et al. | |
| 2006/0096982 | A1 | 5/2006 | Gunter et al. | |
| 2007/0251913 | A1 | 11/2007 | Mengeu | |
| 2008/0202956 | A1 | 8/2008 | Welk et al. | |
| 2009/0232947 | A1 | 9/2009 | Buisson et al. | |
| 2010/0000888 | A1 | 1/2010 | Cronin et al. | |
| 2010/0065076 | A1 | 3/2010 | Bergstrom et al. | |
| 2010/0065077 | A1 | 3/2010 | Lofgreen-Ohrn et al. | |
| 2010/0206754 | A1 * | 8/2010 | Roy | A24F 15/12 206/268 |
| 2011/0083677 | A1 | 4/2011 | Carroll et al. | |
| 2011/0180432 | A1 | 7/2011 | Blick et al. | |
| 2012/0031414 | A1 * | 2/2012 | Atchley | A24B 13/00 131/118 |
| 2012/0141637 | A1 | 6/2012 | Mooney et al. | |
| 2012/0193265 | A1 * | 8/2012 | Patel | A24F 23/00 206/524.6 |
| 2012/0211016 | A1 | 8/2012 | Byrd, Jr. et al. | |
| 2013/0048635 | A1 | 2/2013 | Hoffman et al. | |
| 2013/0236861 | A1 * | 9/2013 | Wilmers | B65D 1/36 434/127 |
| 2013/0276801 | A1 | 10/2013 | Byrd, Jr. et al. | |
| 2013/0292279 | A1 | 11/2013 | Bengtsson et al. | |
| 2014/0197054 | A1 | 7/2014 | Pipes et al. | |
| 2015/0136618 | A1 | 5/2015 | Patel et al. | |

FOREIGN PATENT DOCUMENTS

| | | |
|---|---|---|
| GB | 501224 | 2/1939 |
| GB | 2513165 A | 10/2014 |
| WO | WO 2008/020768 | 2/2008 |
| WO | 2009021855 A1 | 2/2009 |
| WO | WO 2012/139590 | 10/2012 |
| WO | WO 2013/192260 | 12/2013 |

OTHER PUBLICATIONS

Essentra Packaging Consumer; Aquasense™ Active Label Technology From Essentra; Mar. 25, 2014; 2 pages; website visited Oct. 23, 2014 http://consumer.essentrapacking.com/en/home/news/news/2014/03/aquasense%e2%84%a2-active-label-technology-from-essentra/.

Sirane Food Packaging; Sira-Flex™ Resolve ® films and bags for shelf-life extension; 3 pages; website visited Oct. 23, 2014 http://www.sirane.com/food-packaging-products/sira-flex-bags-and-films/sira-flex-resolve.html.

BreatheWay ® Membrane Technology; Intelligent Modified Atmosphee Packaging; 2 pages; downloaded Oct. 23, 2014 http://www.breatheway.com/pdf/BreatheWay_SS_overview6_08.pdf.

Anne Marie Mohan, Senior Editory; Packaging World; Flexible Valve Application Speeds Coffee Packaging; 8 pages; website visited Oct. 23, 2014 http://www.packworld.com/package-component/label/flexible-valve-application-speeds-coffee-packaging.

Hangzhou Cobetter Filtration Equipment Co., Ltd / Hangzhou Fair Filtration Technology Co., Ltd; Membrane Vents; 2 pages; website visited Oct. 23, 2014 http://www.cobetterfilter.com/application/vent_membrane_vents_adhesive_vent.html.

Durata ® Permanent Waterproof Food Safe Bar Top and Wood Counterpart Finish (2 pgs.); Website visited Jun. 10, 2015; http://www.glumber.com/wood-countertops-design-guide/wood-finish/durata-wood-countertop-finish/.

Molded-Pulp Bottle Disrupts Laundry Detergent Category, posted by Anne Marie Mohan, Editor, GreenPackage.com, Jul. 28, 2011 (2 pgs.); Website visited Jun. 10, 2015; http://www.greenerpackage.com/recycled_content/molded-pulp_bottle_disrupts_laundry_detergent_category.

Pulp Fact Not Fiction! PepsiCo files global paper bottle patent ; Ben Bouckley, Mar. 10, 2014 (3 pgs.); Website visited Jun. 10, 2015; http://www.beveragedaily.com/Processing-Packaging/Pulp-fact-not-fiction!-PepsiCo-filed-global-paper-bottle-patent.

Carlsberg Hopes for 'Viable' Wood Fiber Beer Bottle Within Three Years, Ben Bouckley, Jan. 27, 2015 (2 pgs.); Website visited Jun. 10, 2015; http://www.beveragedaily.com/Processing-Packaging-Carlsberg-hopes-for-viable-wood-fiber-beer-bottle-within-three-years.

"A closer look at Carlsberg's fiber bottle", Pat Reynolds, VP Editor (5 pgs.); Website visited Jun. 25, 2015; http://www.packworld.com/package-type/containers/closer-look-carlsbergs-fiber-bottle?utm_source=eClip&utm_medium=newsletter&utm_campaign=eclip-2015-06-25%20-%20Multi-Conveyor%20-%20Actual&spMailingID=1172135&spUserID=NzMzMjkzOTc4NwS2&spJobID=561747181&spReportID=NTYxNzQ3MTgxS0.

PaperBoy Paper Wine Bottle a U.S. First, Anne Marie Mohan, Senior Editor (5 pgs.) Website visited Jun. 10, 2015; http://www.packworld.com/sustainability/renewable-resources/paperboy-paper-wine-bottle-us-first.

Smart Planet Technologies, Earth Coating ® Technology (4 pgs.) Website visited Jun. 10, 2015 http://smartplanettech.com/earthcoating-technology/.

New Stretchable, Shapeable Paper Creates Unique 3D Package, Lisa McTigue Pierce (https://plus.google.com/105400479121017956 96) in Packaging Design (/taxonomy/term/54) on May 20, 2015 (5 pgs.); Website visited Jun. 10, 2015.

Plastic Ingenuity, Green Ingenuity—Pulp Thermoforming and Molded Fiber Packaging (1 pg.); Website visited Jun. 10, 2015; http://www.plasticingenuity.com/green-ingenuity/pulp-thermoforming/.

(56) References Cited

OTHER PUBLICATIONS

Bio Pulp Works, This Old House Magazine: What's New in Tools and Home Products, The Hardware Aisle, Biodegradable Paint Tray (1 pg.); Website visited Jun. 10, 2015; http://www.biopulpworks.com/in-the-news/this-old-house-magazine-whats-new-in-tools-and-home-products.
Partial International Search Report dated Jan. 28, 2016 for Application No. PCT/US2015/055782.
International Search Report and Written Opinion dated Apr. 29, 2016 for Application No. PCT/US2015/055782.
International Search Report for International Application No. PCT/IB2016/057910 dated Mar. 9, 2017.

* cited by examiner

PACKAGE FOR A TOBACCO-CONTAINING MATERIAL AND RELATED PACKAGING METHOD

CROSS-REFERENCE TO RELATED APPLICATIONS

This application is a continuation-in-part of U.S. patent application Ser. No. 14/515,598, filed Oct. 16, 2014, which is hereby incorporated herein by reference in its entirety.

FIELD OF THE DISCLOSURE

The present disclosure relates to packages and related packaging methods. More particularly, this disclosure relates to packages for products made or derived from tobacco, or that otherwise incorporate tobacco, and are intended for human consumption.

BACKGROUND OF THE DISCLOSURE

Tobacco may be enjoyed in a so-called "smokeless" form. Particularly popular smokeless tobacco products are employed by inserting some form of processed tobacco or tobacco-containing formulation into the mouth of the user. See, for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,126 to Strickland et al.; U.S. Pat. No. 7,861,728 to Holton, Jr. et al.; U.S. Pat. No. 7,901,512 to Quinter et al.; U.S. Pat. No. 8,168,855 to Neilsen et al.; U.S. Pat. No. 8,336,557 to Kumar et al.; U.S. Pat. No. 8,469,036 to Strickland et al.; U.S. Pat. No. 8,627,828 to Strickland et al.; U.S. Pat. No. 8,940,344 to Crawford et al.; and U.S. Pat. No. 9,155,772 to Gao et al.; and U.S. Pat. Pub. Nos. 2004/0020503 to Williams; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2009/0065013 to Essen et al.; and 2013/0206153 to Beeson et al.; PCT Pub. Nos. WO 04/095959 to Arnarp et al.; and WO 100/134,444 to Atchley; each of which is incorporated herein by reference.

Representative smokeless tobacco products that have been marketed include those referred to as CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco and RED SEAL long cut by U.S. Smokeless Tobacco Company; and Taboka by Philip Morris USA.

Representative types of snuff products, commonly referred to as "snus," which may comprise pasteurized or heat treated tobacco products, are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. have been marketed under the trade names such as CAMEL Snus Frost, CAMEL Snus Original and CAMEL Snus Spice by R. J. Reynolds Tobacco Company. Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus products typically do not require expectoration by the user. Other pouch types of smokeless tobacco products include those marketed as COPENHAGEN Pouches, SKOAL Bandits, SKOAL Pouches, REVEL Mint Tobacco Packs by U.S. Smokeless Tobacco Company; and MARLBORO Snus by Philip Morris USA.

Various types of containers for dispensing moistened solid components, particularly components intended for human consumption, are known in the art. Such containers are often characterized by a hand-held size that can be easily stored and transported. For example, snus products have been packaged in tins, "pucks" or "pots" that are manufactured from metal or plastic. See, for example, those types of containers generally disclosed in U.S. Pat. No. 4,098,421 to Foster; U.S. Pat. No. 4,190,170 to Boyd and U.S. Pat. No. 8,440,023 to Carroll et al.; and U.S. Patent Pub. Nos. 2010/0065076 to Bergstrom et al.; 2010/0065077 to Lofgreen-Ohrn et al.; 2012/0024301 to Carroll et al. and 2012/0193265 to Patel et al.; each of which is incorporated by reference herein. Yet other types of containers for smokeless types of tobacco products are set forth in U.S. Pat. No. 8,458,996 to Bried et al.; U.S. Pat. No. D574,709 to Crofts et al. and U.S. Pat. No. D649,284 to Patel et al.; U.S. Patent Pub. Nos. 2008/0202956 to Welk et al., 2010/0012534 to Hoffman, 2010/0018883 to Patel et al., and 2014/0197054 to Pipes et al.; as well as the various types of containers referenced in U.S. Patent Pub. No. 2013/0206153 to Beeson et al.; each of which is incorporated by reference herein. Further, U.S. Pat. No. 8,567,597 to Gibson et al. discloses a compartment container for snus, and is incorporated herein by reference in its entirety.

A desirable feature for certain containers is the protection of the product from environmental effects, particularly those effects that may degrade the product stored in the container. For example, venting of gas out of the enclosure formed by the sealed container may be needed for properly storing a product. By way of further example, certain tobacco-containing materials such as moist snuff include active microbes which may produce gases while stored in the container. Thus, for example, the container may include a rib structure as disclosed in U.S. Pat. Pub. No. 2012/0193265 to Patel et al., which is incorporated herein by reference. Inclusion of the rib structure or other venting features may undesirably allow for continuous release of moisture from the tobacco-containing product. Thus, the container may additionally include an intermediate wall and an environment modification material as disclosed in U.S. Pat. Pub. No. 2015/0136618 to Patel et al., which is incorporated herein by reference. However, such features may increase the cost and complexity of the container.

It would thus be desirable to provide packaging for smokeless tobacco products and the like, wherein the packaging provides various advantageous features configured to vent the internal space or otherwise affect an atmosphere therein while limiting moisture loss. Alternatively or additionally, it may be desirable to provide containers with improved aesthetic appearance and/or to configure containers so as to impart a desired aroma or taste to a product received therein.

BRIEF SUMMARY OF THE DISCLOSURE

The present disclosure relates to packages that, in certain embodiments, are configured to affect an atmosphere within an internal space within a container in which a product is stored by releasing pressure through a one-way valve assembly, while limiting moisture loss, and which can be provided in a convenient handheld size. The type and form of the product to be stored can vary, but preferably is a tobacco-containing material, such as a smokeless form tobacco product.

In one aspect a package is provided. The package may include a container. The container may include a body portion defining an internal space accessible via an opening and configured to receive a tobacco-containing material. The container may additionally include a cover configured to engage the body portion so as to cover the opening and substantially enclose the internal space. Further, the package may include a valve assembly in fluid communication with the internal space and configured to affect an atmosphere within the internal space of the container.

In some embodiments the valve assembly may be configured to relieve pressure from the atmosphere within the internal space of the container. Additionally, the valve assembly may be configured to resist moisture outflow from the atmosphere within the internal space. The valve assembly may be engaged with the cover of the container. Further, the body portion may include a side wall and a bottom wall. The valve assembly may be engaged with at least one of the side wall and the bottom wall of the body portion of the container.

In some embodiments the package may additionally include a barrier film coupled to the container. The valve assembly may be engaged with the barrier film. The barrier film may cover the opening to the body portion.

A secondary space may be defined between the barrier film and the cover when the cover is engaged with the body portion. The valve assembly may be configured to vent from the internal space into the secondary space. One or more vent channels may be defined between the cover and the body portion when the cover is engaged with the body portion. The vent channels may be configured to vent the secondary space to an external environment.

In some embodiments an aperture may be defined through the container, and the barrier film may extend over the aperture. A secondary space may be defined between the barrier film and the container. The secondary space may be in fluid communication with the internal space through the aperture and the valve assembly may be configured to vent from the secondary space to an external environment. The barrier film may extend across a joint between the body portion and the cover of the container. The valve assembly may be in fluid communication with the internal space through one or more vent channels defined between the cover and the body portion when the cover is engaged with the body portion. A peripheral film may enclose the container. The valve assembly may be engaged with the peripheral film.

In some embodiments the valve assembly may be selected from a group consisting of a spring valve, a ball valve, a diaphragm valve, and a valve comprising a plurality of fluid-impervious layers. The package may additionally include a protective barrier that separates the product from the valve assembly. The product may comprise a tobacco-containing material. The tobacco-containing material may comprise moist snuff. The package may further comprise a barrier film. The barrier film may secure the valve assembly to the container such that the valve assembly is in fluid communication with the internal space within the container.

In an additional aspect a packaging method is provided. The packaging method may include providing a package. The package may include a container. The container may include a cover and a body portion defining an internal space accessible via an opening. The package may additionally include a valve assembly configured to affect an atmosphere within the internal space. The packaging method may additionally include inserting a product (e.g., a tobacco-containing material) through the opening into the internal space in the body portion. The packaging method may also include engaging the cover with the body portion so as to cover the opening and substantially enclose the internal space.

In some embodiments the packaging method may additionally include positioning the valve assembly in fluid communication with the internal space and an external environment. Positioning the valve assembly may include engaging the valve assembly with the cover of the container. In another embodiment positioning the valve assembly may include engaging the valve assembly with at least one of a side wall and a bottom wall of the body portion of the container.

In some embodiments the packaging method may further comprise coupling a barrier film to the container. The valve assembly may be engaged with the barrier film. Coupling the barrier film to the container may include covering the opening to the body portion. Engaging the cover with the body portion may include defining a secondary space between the barrier film and the cover. The valve assembly may be configured to vent from the internal space into the secondary space. Engaging the cover with the body portion may further include defining one or more vent channels between the cover and the body portion. The vent channels may be configured to vent the secondary space to an external environment. Coupling the barrier film to the container may include positioning the barrier film over an aperture defined through the container.

In some embodiments, coupling the barrier film to the container further may further include defining a secondary space between the barrier film and the container. The secondary space may be in fluid communication with the internal space through the aperture and the valve assembly may be configured to vent from the secondary space to an external environment.

In some embodiments, coupling the barrier film to the container may include positioning the barrier film over a joint between the body portion and the cover of the container. Engaging the cover with the body portion may include defining one or more vent channels between the cover and the body portion. The valve assembly may be in fluid communication with the internal space through the vent channels.

Further, in some embodiments the packaging method may include engaging the valve assembly with the barrier film such that the valve assembly is in fluid communication with the internal space and an external environment. The packaging method may further include enclosing the cover and the body portion with a peripheral film. The packaging method may also include engaging the valve assembly with the peripheral film such that the valve assembly is in fluid communication with the internal space and an external environment.

In an additional aspect a container is provided. The container may include a body portion defining an internal space accessible via an opening and configured to receive a product. The container may further include a cover configured to engage the body portion so as to cover the opening and substantially enclose the internal space. The cover and the body portion may respectively define an inner surface. The container may additionally include a wood liner engaged with at least one of the inner surface of the cover and the inner surface of the body portion.

In some embodiments the body portion may include an injection molded plastic. Further, the wood liner may include an in-molded label, the wood liner may be coupled to the inner surface via an adhesive, the wood liner may be coupled to the inner surface via a bonding process, or the container may further include an insert configured to hold the wood liner to the inner surface.

In some embodiments the wood liner may be selected from a group consisting of Spanish cedar, cedar, pine, balsam, oak, pinion, fir, juniper, sandalwood, rose wood, Applewood, and moon beam. The wood liner may include wood previously employed to store or age tobacco. The wood liner may include a wood veneer. The wood veneer may include a backed veneer or the wood veneer may include a raw veneer.

In some embodiments the container may be provided in combination with a plurality of units of a product received in the internal storage compartment. The product may be selected from the group consisting of pharmaceutical products, smoking products, smokeless tobacco products, and consumable products.

In an additional aspect a method for manufacturing a container is provided. The method may include providing a body portion defining an internal space accessible via an opening. Further, the method may include providing a cover configured to engage the body portion so as to cover the opening and substantially enclose the internal space. The cover and the body portion may respectively define an inner surface. The method may additionally include engaging a wood liner with at least one of the inner surface of the cover and the inner surface of the body portion.

In some embodiments providing the body portion may include injection molding the body portion. Engaging the wood liner with the inner surface of the body portion may be conducted simultaneously with injection molding the body portion. Engaging the wood liner with the inner surface of the body portion may include in-mold labeling. Engaging the wood liner with at least one of the inner surface of the cover and the inner surface of the body portion may include coupling the wood liner to the inner surface via an adhesive. Engaging the wood liner with at least one of the inner surface of the cover and the inner surface of the body portion may include bonding the wood liner to the inner surface. Engaging the wood liner with at least one of the inner surface of the cover and the inner surface of the body portion may include engaging an insert with the wood liner.

In some embodiments the method may further include inserting a product through the opening into the internal space in the body portion. Engaging the wood liner with at least one of the inner surface of the cover and the inner surface of the body portion may include engaging a backing layer with the inner surface. Engaging the wood liner with at least one of the inner surface of the cover and the inner surface of the body portion may include engaging a wood veneer with at least one of the inner surface of the cover and the inner surface of the body portion.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1:
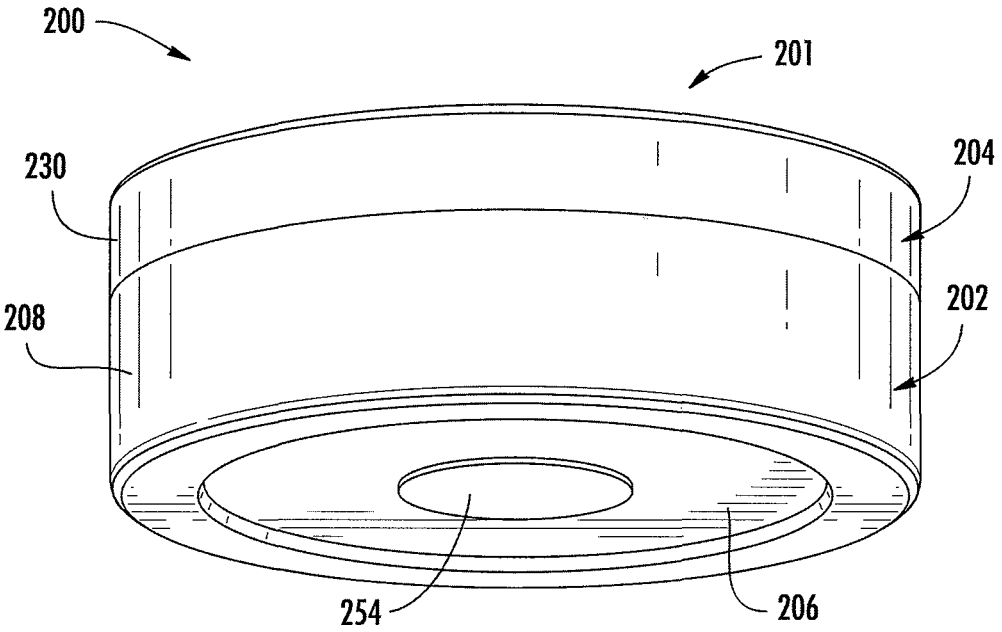
Figure 2:
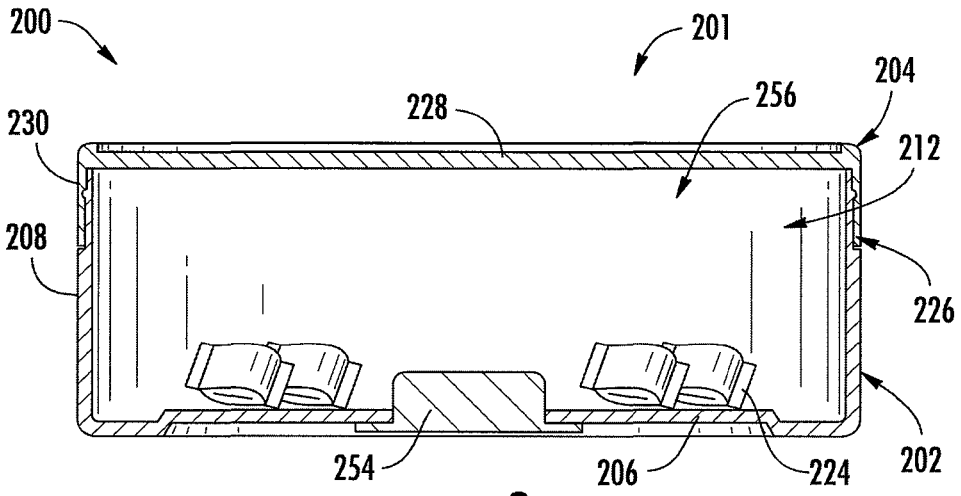
Figure 3:
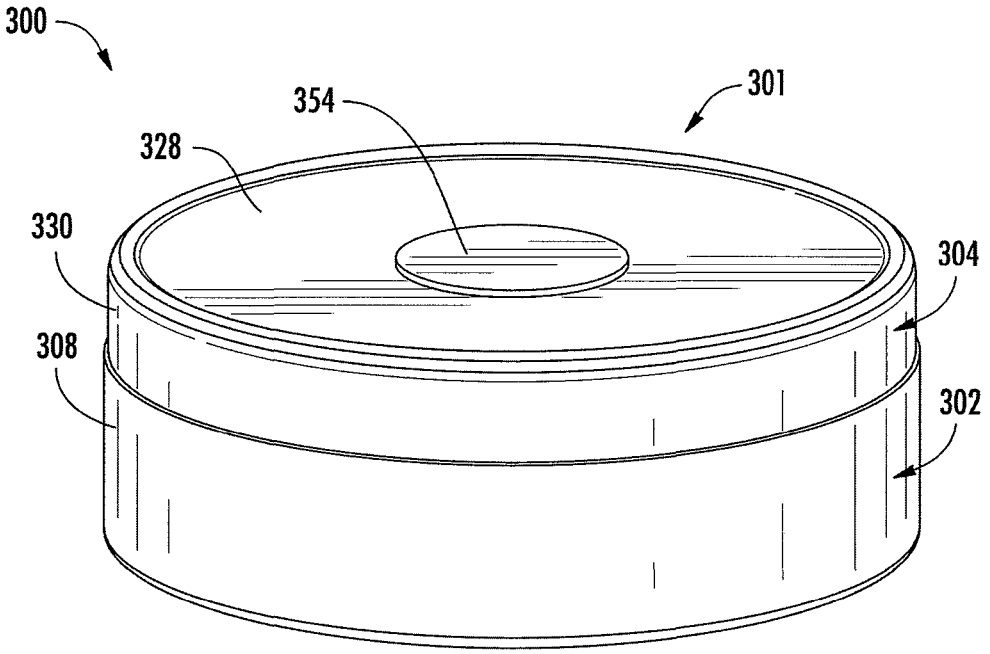
Figure 4:
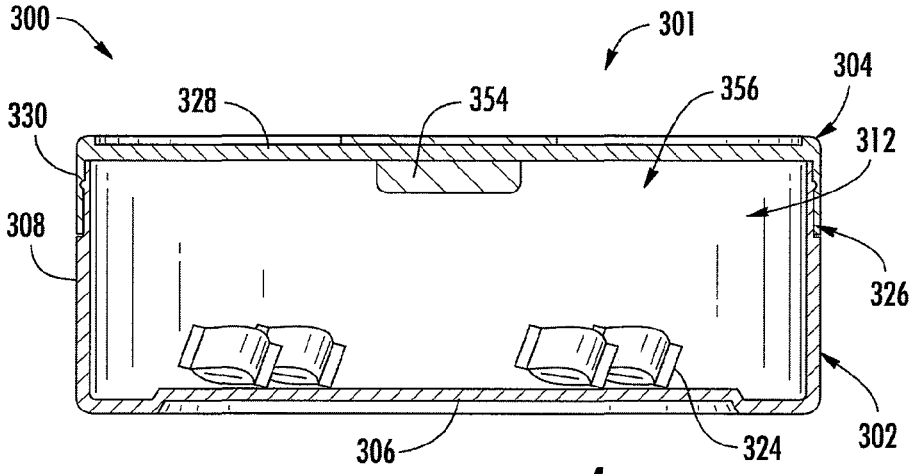
Figure 5:
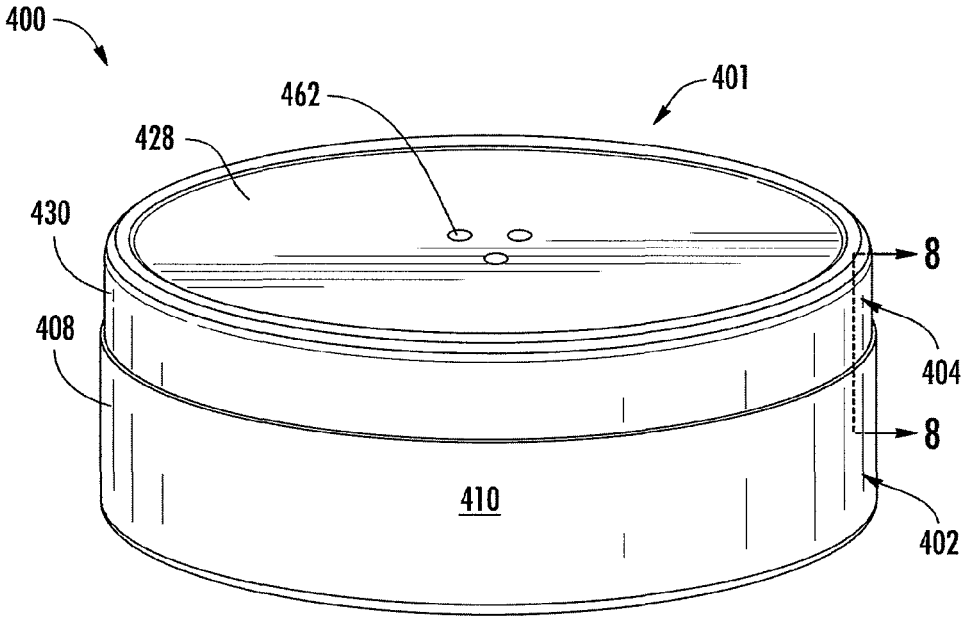
Figure 6:
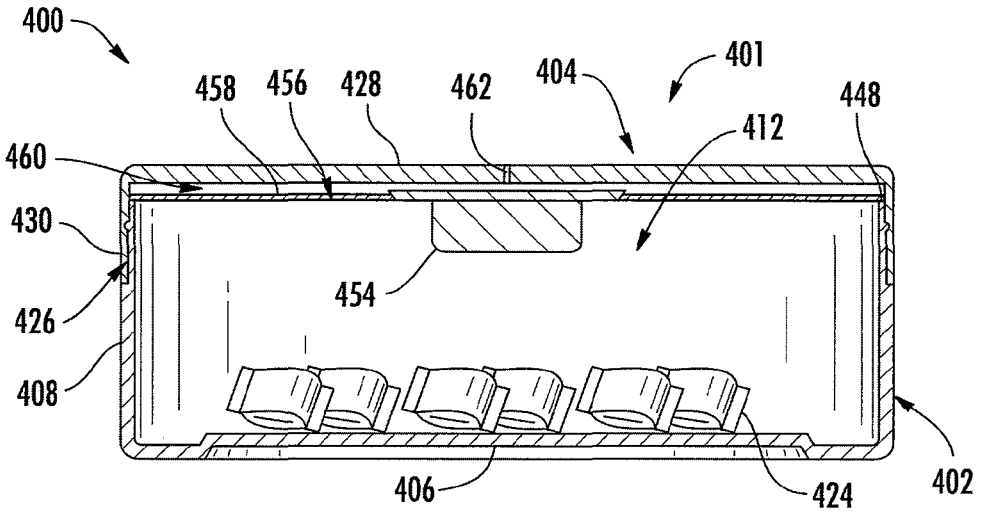
Figure 7:
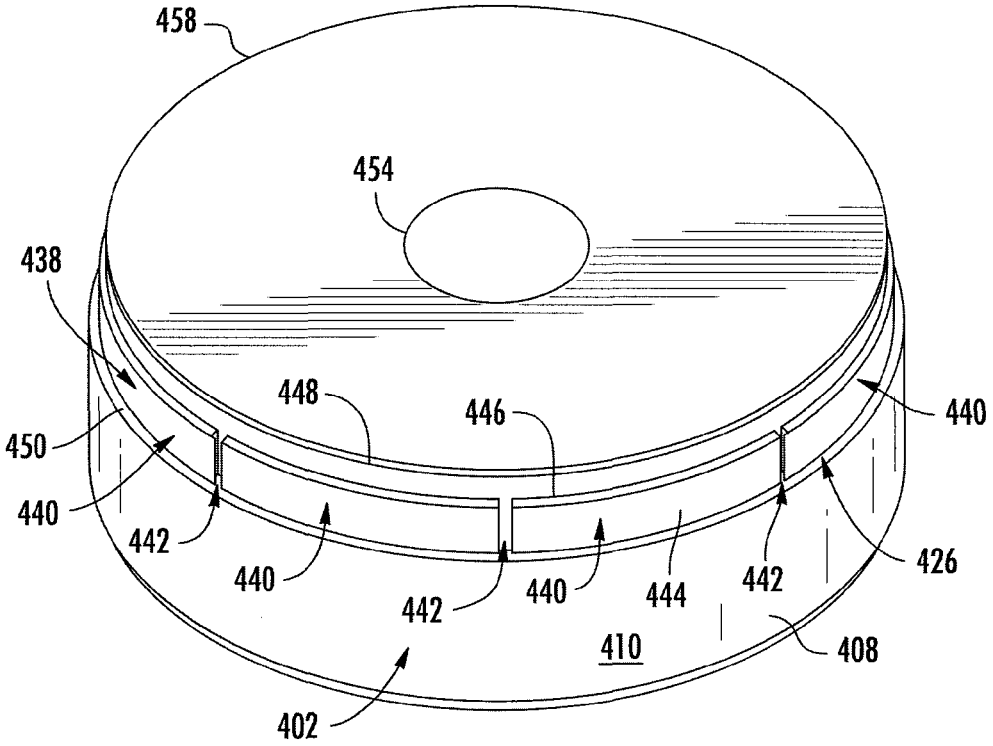
Figure 8:
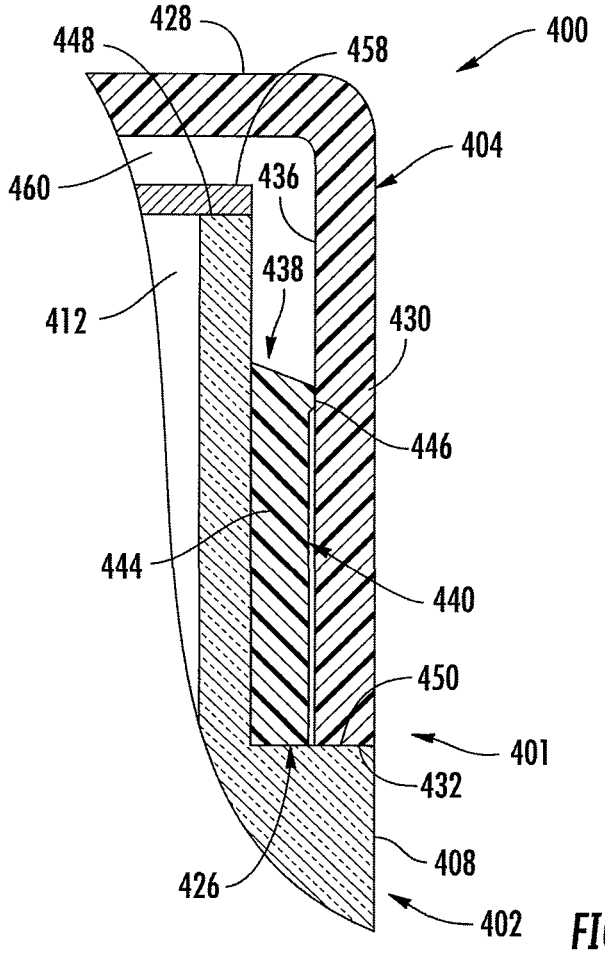
Figure 9:
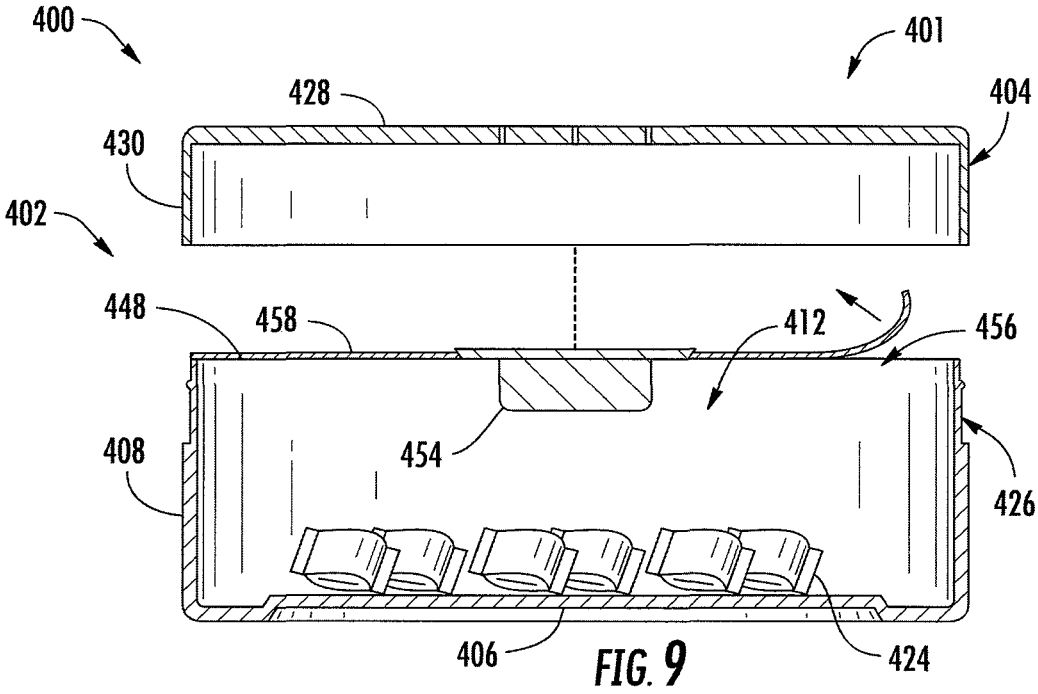
Figure 10:
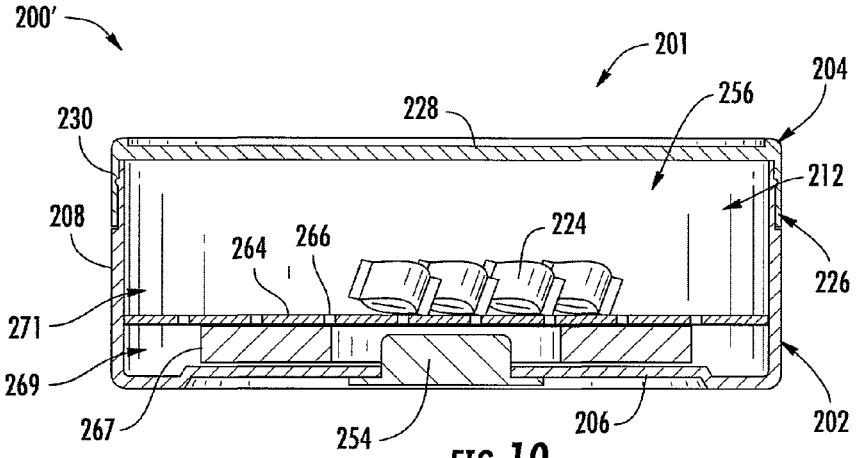
Figure 11:
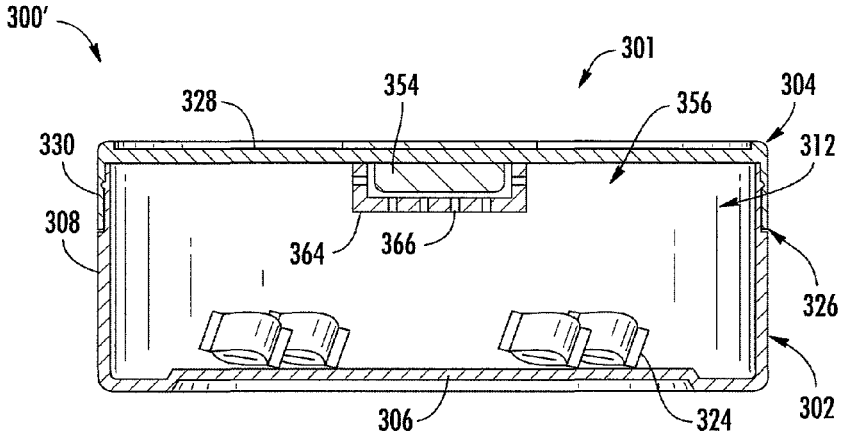
Figure 12:
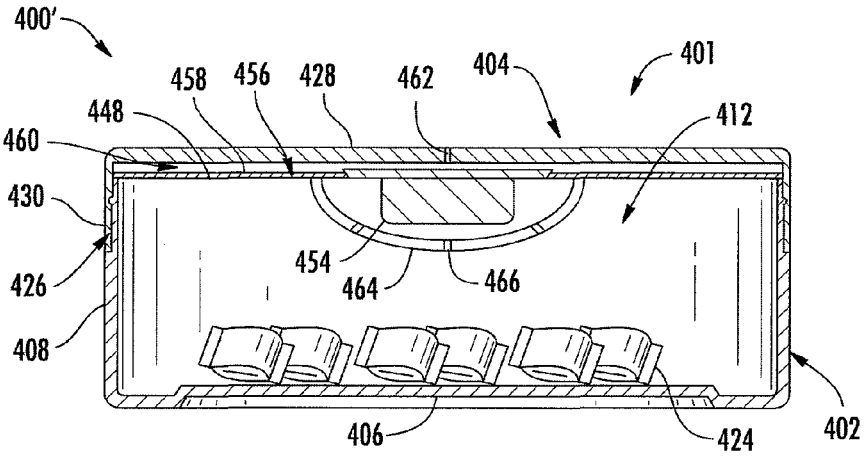
Figure 13:
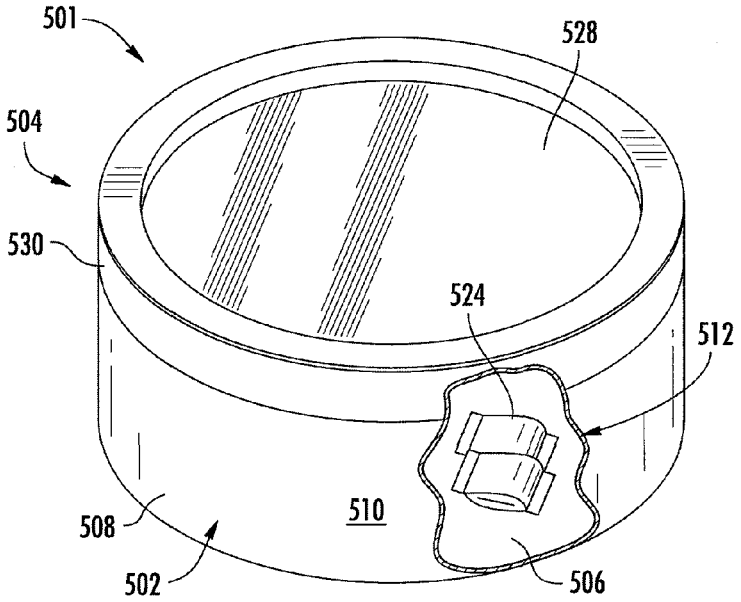
Figure 14:
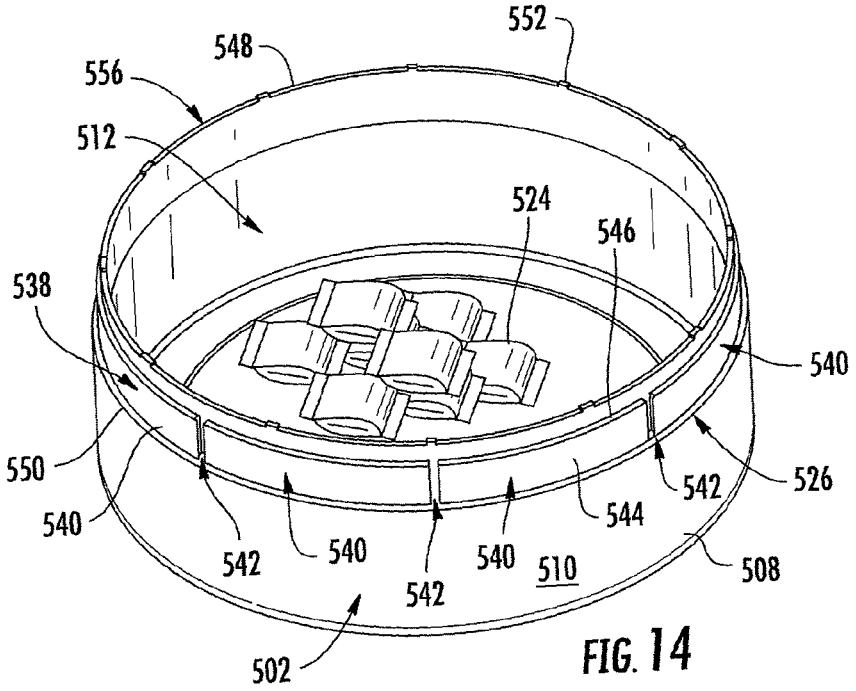
Figure 15:
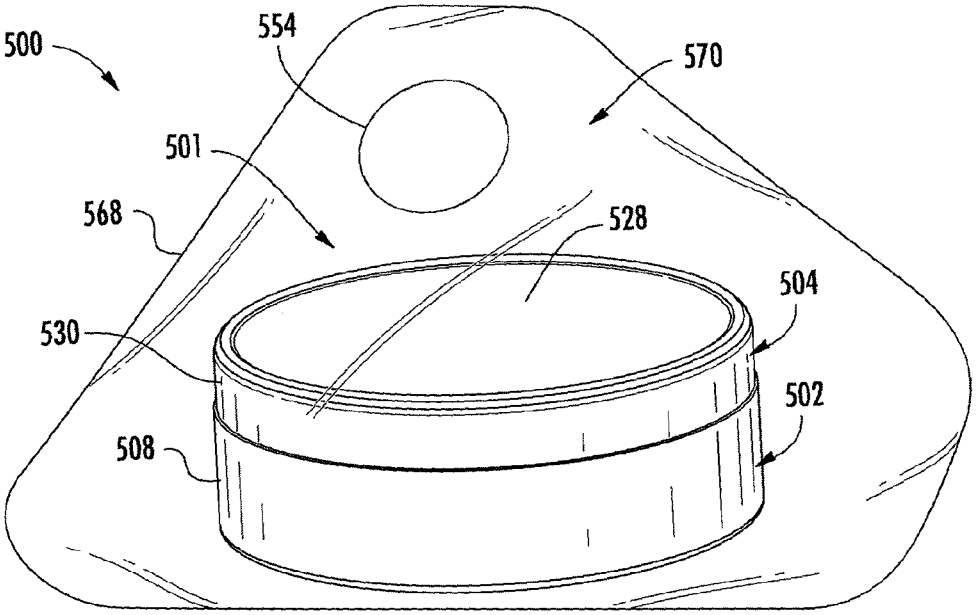
Figure 16:
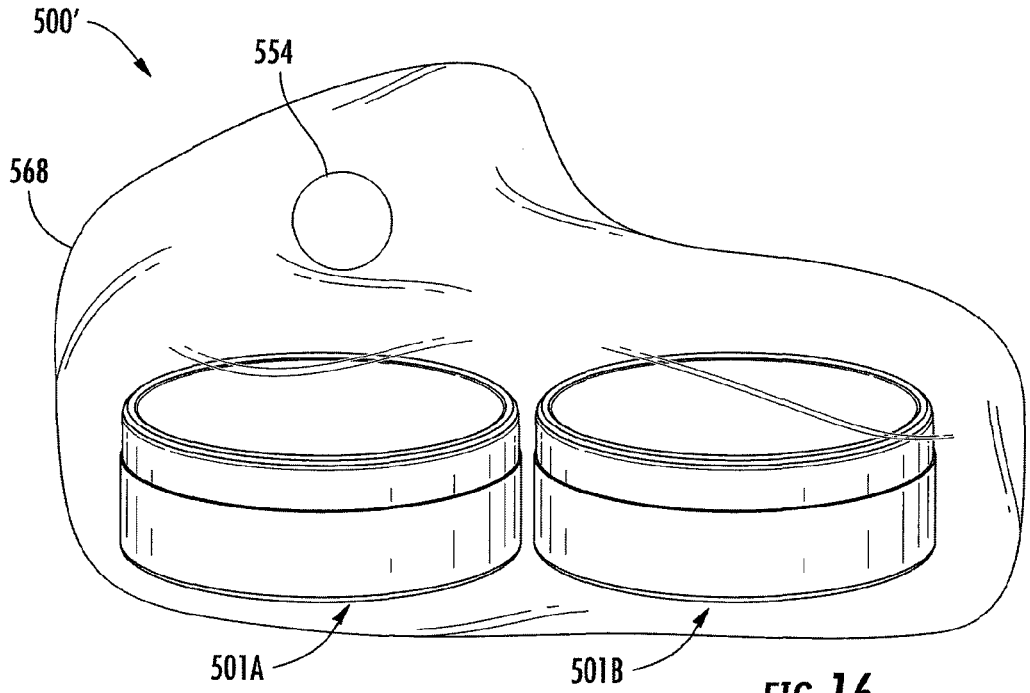
Figure 17:
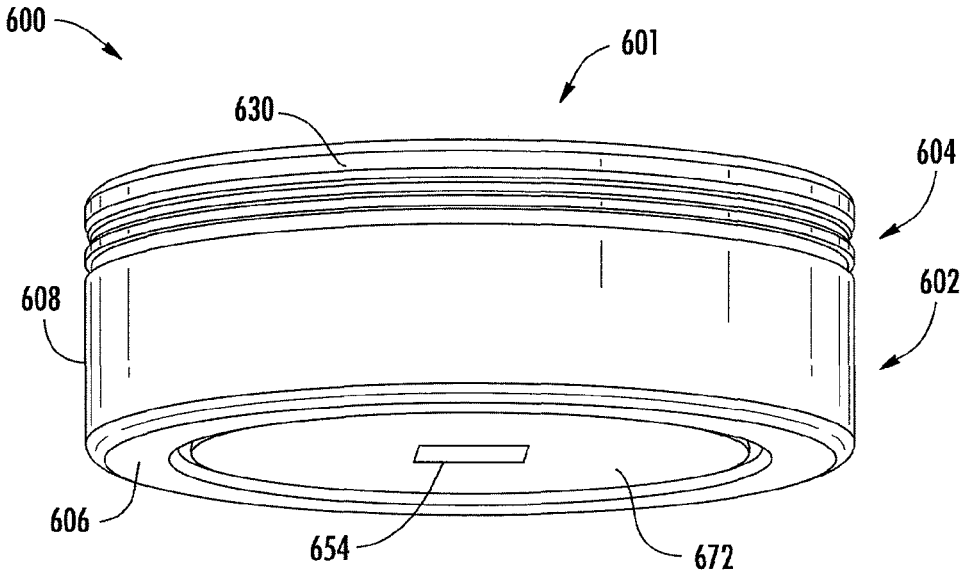
Figure 18:
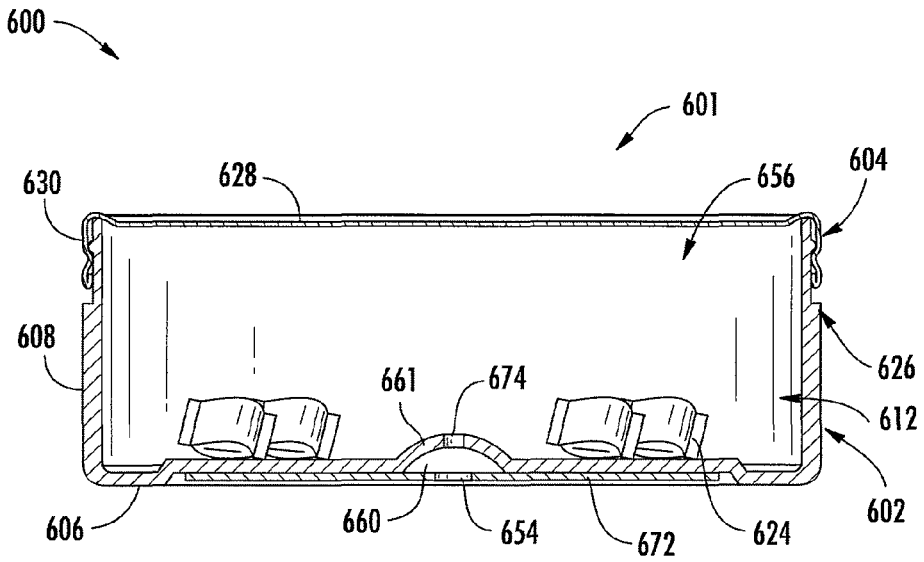
Figure 19:
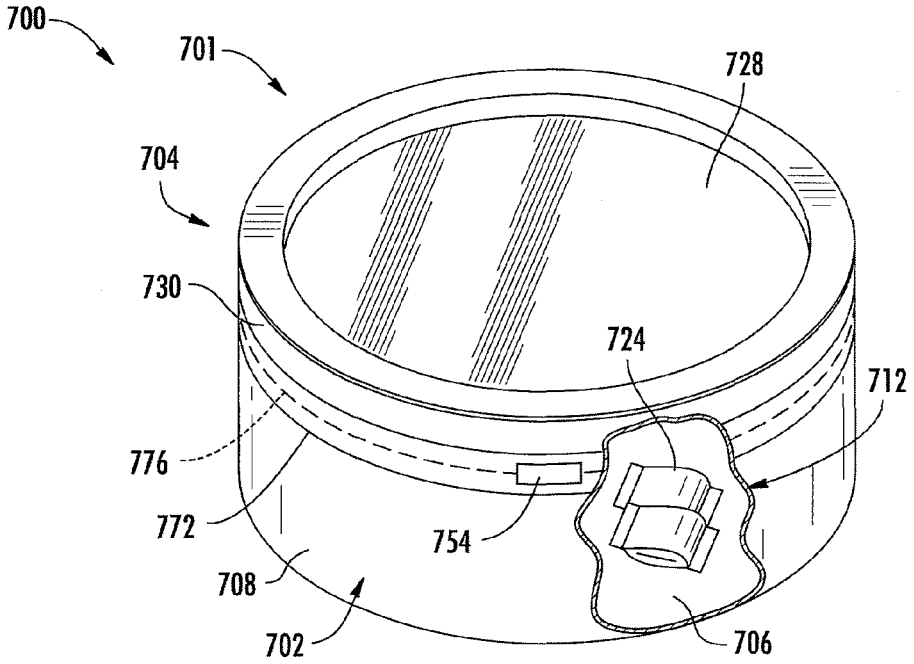
Figure 20:
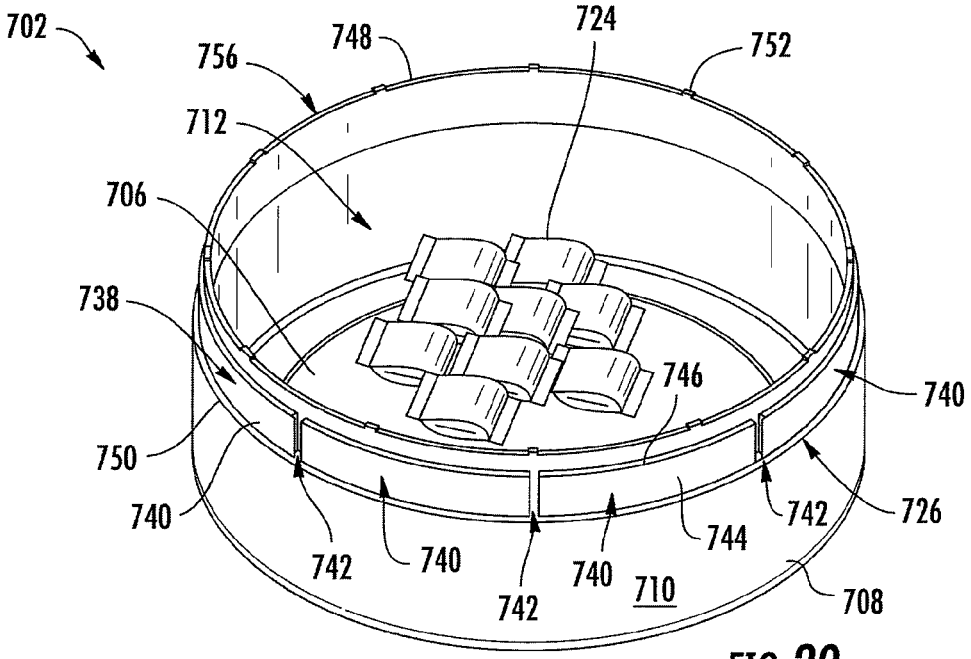
Figure 21:
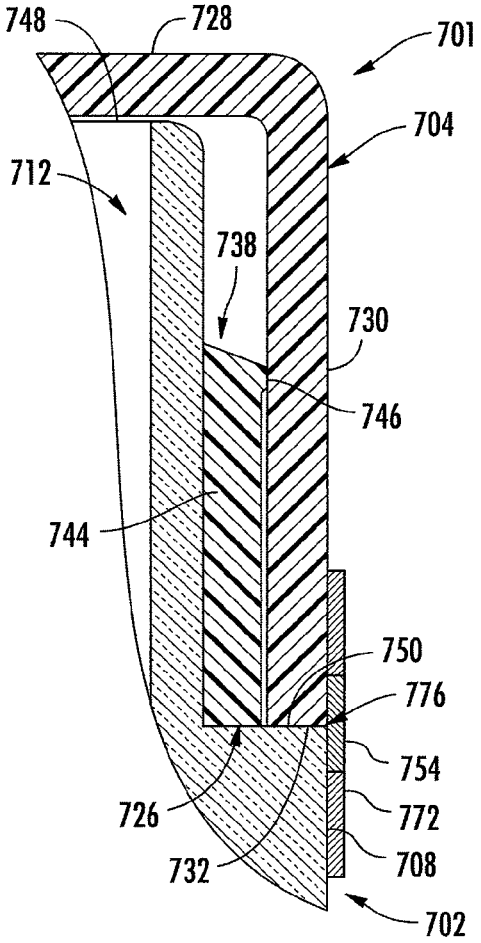
Figure 22:
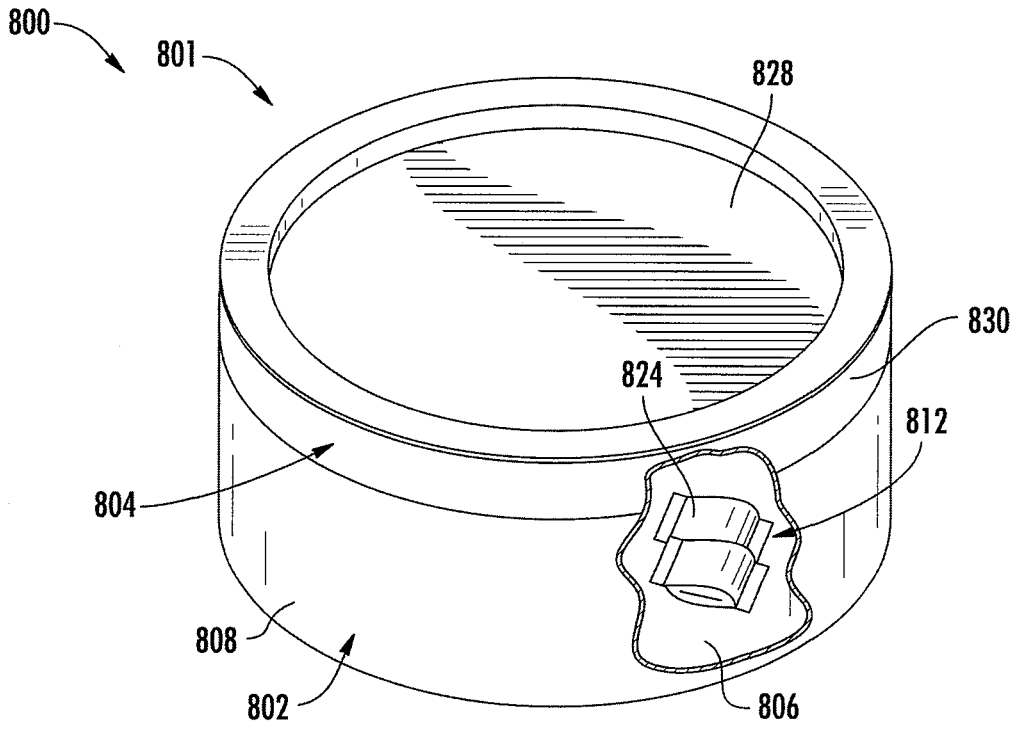
Figure 23:
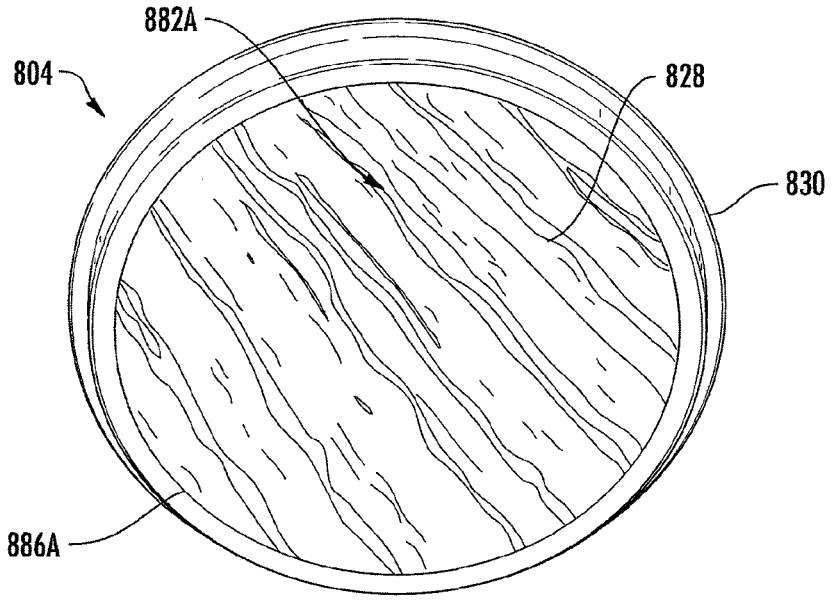
Figure 24:
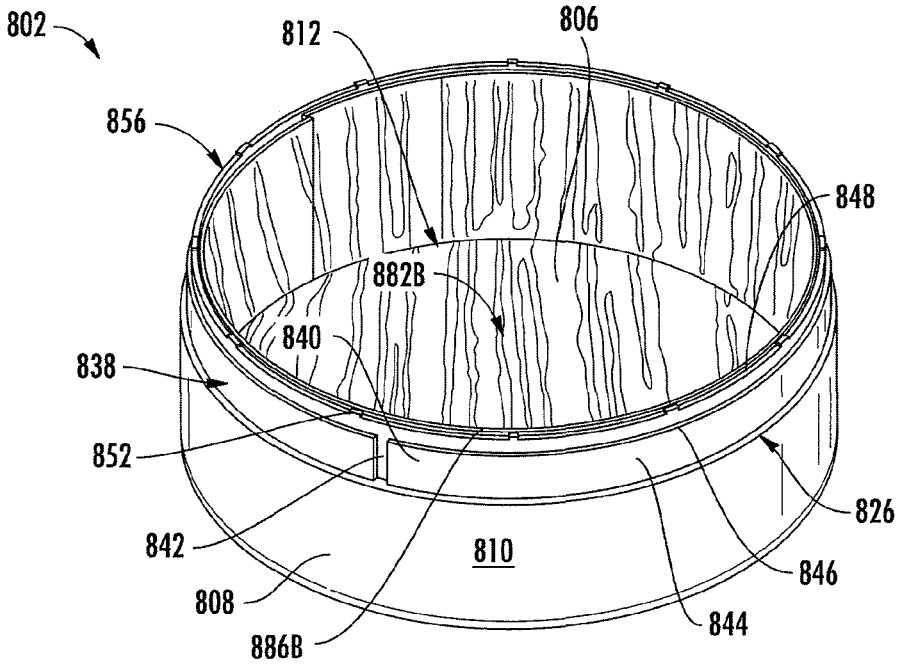
Figure 25:
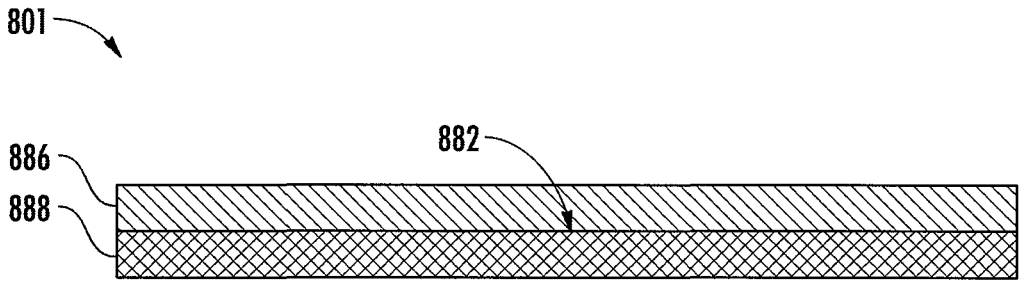
Figure 26:
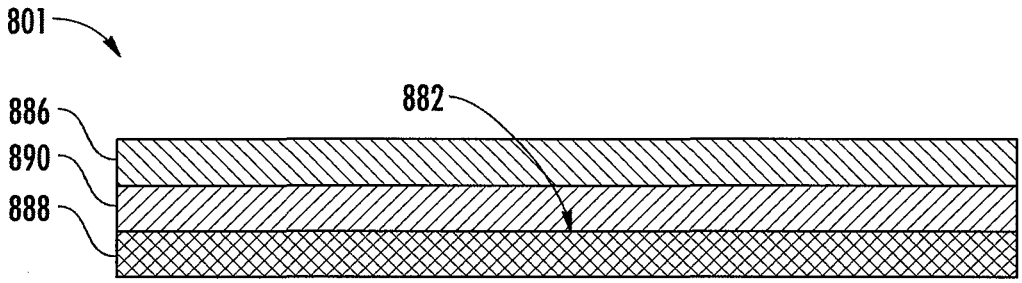
Figure 27:
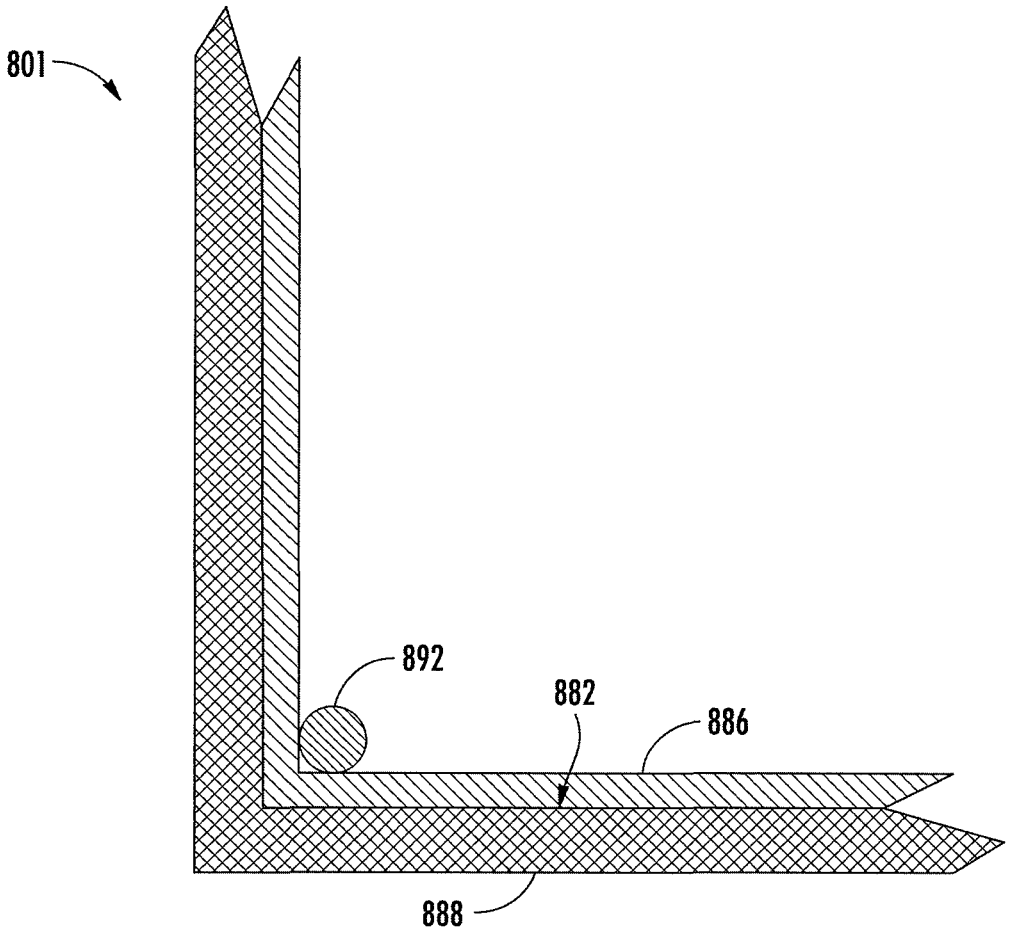
Figure 28:
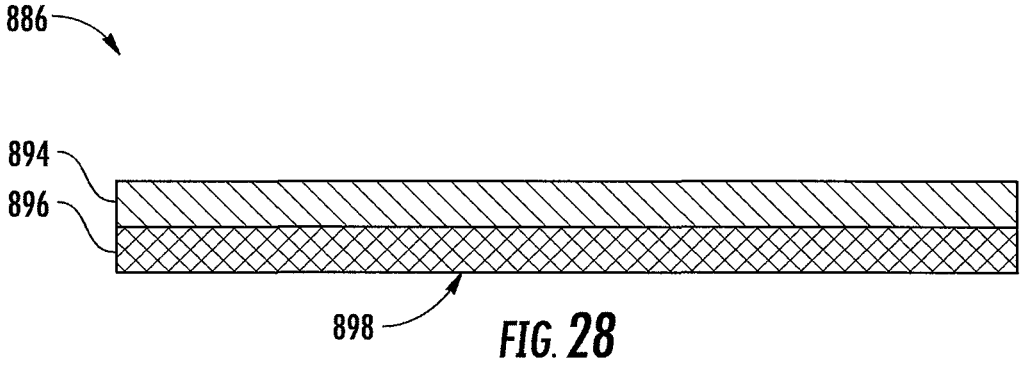
Figure 29:
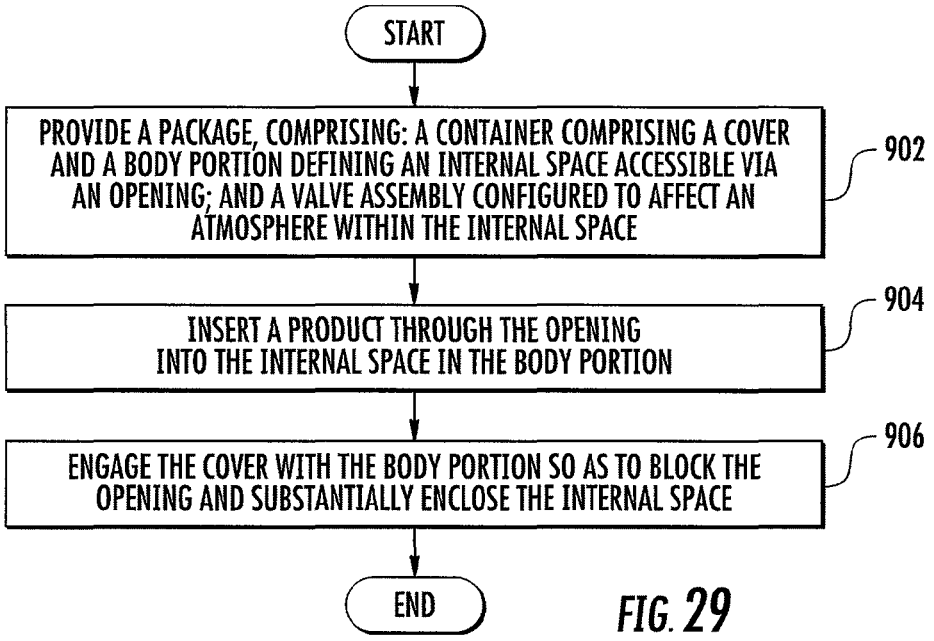
Figure 30:
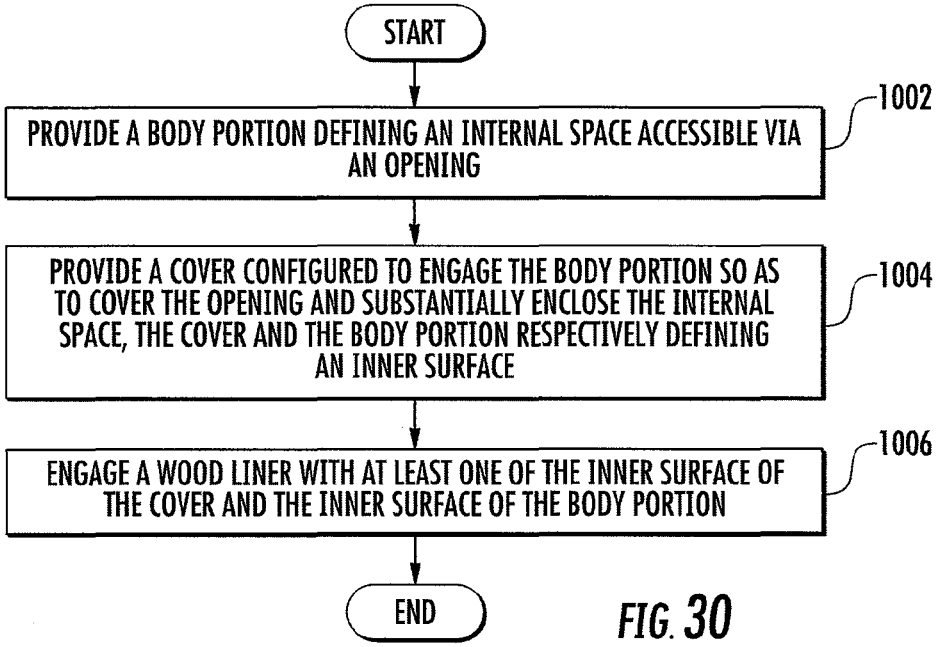

Having thus described the disclosure in general terms, reference will now be made to the accompanying drawings, which are not necessarily drawn to scale, and wherein:

FIG. 1 illustrates a perspective view of a package including a container and a valve assembly coupled to a body portion of the container according to an example embodiment of the present disclosure;

FIG. 2 illustrates a sectional view through the package of FIG. 1;

FIG. 3 illustrates a perspective view of a package including a container and a valve assembly coupled to a cover of the container according to an example embodiment of the present disclosure;

FIG. 4 illustrates a sectional view through the package of FIG. 3;

FIG. 5 illustrates a perspective view of a package including a container, a barrier film, and a valve assembly engaged with the barrier film according to an example embodiment of the present disclosure;

FIG. 6 illustrates a section view through the package of FIG. 5;

FIG. 7 illustrates a perspective view of, the barrier film, the valve assembly, and a body portion of the container of FIG. 5;

FIG. 8 illustrates an enlarged sectional view along line 8-8 of the container of FIG. 5;

FIG. 9 illustrates a sectional view through the package of FIG. 5 illustrating movements involved in accessing a tobacco-containing material received therein;

FIG. 10 illustrates a package that is substantially similar to the package of FIG. 1 and further includes a protective barrier according to an example embodiment of the present disclosure;

FIG. 11 illustrates a package that is substantially similar to the package of FIG. 3 and further includes a protective barrier according to an example embodiment of the present disclosure;

FIG. 12 illustrates a package that is substantially similar to the package of FIG. 5 and further includes a protective barrier according to an example embodiment of the present disclosure;

FIG. 13 illustrates a perspective view of a container without a valve assembly directly engaged therewith according to an example embodiment of the present disclosure;

FIG. 14 illustrates a perspective view of a body portion of the container of FIG. 13;

FIG. 15 illustrates a package including the container of FIG. 13, a peripheral film, and a valve assembly according to an example embodiment of the present disclosure;

FIG. 16 illustrates a package that includes a plurality of the containers of FIG. 13, a peripheral film, and a valve assembly according to an example embodiment of the present disclosure;

FIG. 17 illustrates a perspective view of a package including a barrier film and a valve assembly coupled to a body portion of a container according to an example embodiment of the present disclosure;

FIG. 18 illustrates a sectional view through the package of FIG. 17;

FIG. 19 illustrates a perspective view of a package including a barrier film and a valve assembly coupled to a joint between a cover and a body portion of a container according to an example embodiment of the present disclosure;

FIG. 20 illustrates a perspective view of a body portion of the container of FIG. 19;

FIG. 21 illustrates a sectional view through the container of FIG. 19 at the valve assembly;

FIG. 22 illustrates a modified perspective view of package including a product and a container including a wood liner according to an example embodiment of the present disclosure;

FIG. 23 illustrates a perspective view of an inside of a cover of the container of FIG. 22 according to an example embodiment of the present disclosure;

FIG. 24 illustrates a perspective view of a side and an inside of a body portion of the container of FIG. 22 according to an example embodiment of the present disclosure;

FIG. 25 illustrates a sectional view through the container of FIG. 22 including a primary structural layer and a wood liner according to an example embodiment of the present disclosure;

FIG. 26 illustrates a sectional view through the container of FIG. 22 including a primary structural layer, a wood liner, and an adhesive according to an example embodiment of the present disclosure;

FIG. 27 illustrates a sectional view through the body portion of FIG. 24 including a primary structural layer, a wood liner, and an insert according to an example embodiment of the present disclosure;

FIG. 28 illustrates a sectional view through the wood liner of FIG. 25 including slices of wood and a backing layer;

FIG. 29 schematically illustrates a packaging method according to an example embodiment of the present disclosure; and FIG. 30 illustrates a method for manufacturing a container according to an example embodiment of the present disclosure.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

As described in detail hereinafter, the present disclosure is directed to packages including a container and a valve. The packages may be configured to store a tobacco-containing material such as moist snuff, which may off-gas during storage within the container. The valve may release pressure and gas from the container while limiting moisture loss, in comparison to venting structures that are permanently open.

In another embodiment the present disclosure is directed to a container including a wood liner, which may comprise a wood veneer. Optionally, the container may be included in a package further comprising a valve and/or other venting structures as mentioned above and described elsewhere herein. However, the valve and the venting structures are optional components that need not be included with all embodiments of the container.

The container embodiments described herein can be used to store various solid products, but are particularly well-suited for products designed for oral consumption. Exemplary consumable products that are often packaged in such containers include a wide variety of moist consumer products, including tobacco products of the type that have a smokeless form. Various forms of suitable smokeless tobacco products are those types products set forth and described generally in U.S. Patent Pub. Nos. 2012/0193265 to Patel et al. and 2013/0206153 to Beeson et al.; which are incorporated by reference herein. Of particular interest, are exemplary tobacco products that include tobacco formulations in a loose form, such as moist snuff products. Other exemplary types of smokeless tobacco products include the types of products set forth in U.S. Pat. No. 2012/0024301 to Carroll et al., which incorporated by reference herein. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. Exemplary snus forms of tobacco products are commercially available as CAMEL Snus by R. J. Reynolds Tobacco Company.

The shape of the outer surface of the containers of the disclosure can vary. Although the container embodiments illustrated in the drawings have certain contours and shapes, containers with other exterior and interior surface designs also can be suitably adapted and used. For example, the sides or edges of the containers of the disclosure can be flattened, rounded, or beveled, and the various surfaces or edges of the container exterior can be concave or convex. Further, the opposing sides, ends, or edges of the container can be parallel or non-parallel such that the container becomes narrower in one or more dimensions. See, for example, the types of containers, components, component arrangements and configurations, and constructions thereof set forth in U.S. Pat. No. 8,458,996 to Bried et al., U.S. Pat. No. 8,910,781 to Pipes et al., and U.S. Pat. No. D649,284 to Patel et al.; U.S. Patent Pub. No. 2010/0018883 to Patel et al; as well as the various types of containers referenced in U.S. Patent Pub. No. 2013/0206153 to Beeson et al.; each of which is incorporated by reference herein.

The dimensions of the containers described herein can vary without departing from the disclosure. However, in highly preferred embodiments, the containers can be described as having a cylindrical shape suitable for handheld manipulation and operation. Exemplary dimensions for such handheld generally cylindrical embodiments include diameters in the range of about 50 mm to about 100 mm, and more typically about 60 mm to about 80 mm. Exemplary wall thicknesses include the range of about 0.5 mm to about 1.5 mm, and more typically about 0.8 mm to about 1.4 mm. Exemplary depths for handheld container embodiments of the present disclosure range from about 5 mm to about 50 mm, more typically about 8 mm to about 30 mm, and most often about 15 mm to about 25 mm. An exemplary general outward appearance of the container is comparable in many regards to that which has been used for commercially available GRIZZLY and KODIAK products that are marketed by American Snuff Company, LLC.

Further, the size of the containers described herein may be changed. For example, the containers may be sized for promotional purposes by providing either increased or decreased dimensions. For example, the dimensions of the containers may be scaled upwardly or downwardly by certain multipliers. By way of further example, the dimensions of the container may be scaled upwardly or downwardly by a multiple of about 1 to about 10 times. In this regard, whereas a conventional container according to embodiments of the present disclosure may be configured to store about 1.2 ounces of a tobacco-containing material, an oversized container may be configured to store, for example, 2.4 ounces or 7.2 ounces of the tobacco containing material. In specialty markets the containers may define a larger cylindrical configuration having a diameter from about 100 mm to about 125 mm (e.g., preferably about 114 mm) and a depth from about 30 mm to about 50 mm (e.g., preferably about 38 mm) Accordingly, the dimensions and capacities disclosed herein are provided for example purposes only and may be modified to suit particular purposes.

Therefore, the present disclosure recites various additional or alternative features configured to allow a container to vent, particularly with respect to example embodiments of a package including a container and a valve assembly. As described below, the valve assembly may be configured to affect an atmosphere within the internal space of the container. The valve assembly may be coupled to or otherwise associated with the container in any of a variety of manners as discussed hereinafter.

In this regard, FIG. 1 illustrates a perspective view of a package 200 according to an example embodiment of the present disclosure. As illustrated, the package 200 includes a container 201, which may include a body portion 202 and a cover 204 removably secured thereto. The body portion 202 may include a bottom wall 206 and a side wall 208 extending therefrom. As illustrated, in some embodiments the bottom wall 206 may be substantially planar and the side wall 208 may be generally tubular-shaped.

As illustrated in FIG. 2, the cover 204 may include a top wall 228 and a peripheral flange 230. The top wall 228 may be substantially planar. Further, the peripheral flange 230 may extend downwardly from the top wall 228. Thereby, the peripheral flange 230 of the cover 204 may engage an upper portion 226 of the side wall 208 of the body portion 202. For example, the peripheral flange 230 of the cover 204 may engage the upper portion 226 of the side wall 208 via a snap-fit or an interference fit.

When the cover 204 engages the body portion 202, the container 201 may define a substantially cylindrical configuration. However, as may be understood, the container may define various other shapes. The body portion 202 may define an internal space 212, which may be substantially enclosed when the cover 204 is engaged with the body portion, and which may be accessible via an opening 256 when the cover is removed therefrom. The internal space 212 of the body portion 202 may be configured to receive a product such as a tobacco-containing material 224 (e.g., moist snuff). As illustrated, the cover 204 may be configured to engage the body portion 202 so as to cover the opening 256 and substantially enclose the internal space 212.

The amount of the tobacco-containing material 224 received in the internal space 212 can vary. Typically, for example, when the tobacco-containing material 224 is a loose tobacco product, the amount of stored moist tobacco product varies from about 20 g to about 50 g, and most often from about 30 g to about 40 g. When the tobacco-containing material 224 is a pouched or snus-type of product, the number of product units received in the internal space can also vary, and will depend upon factors such as the size of the container 201, the size of the product units, the degree of container fill, and the like. Typically, the number of stored pouched product units will vary from about 5 to about 30, more typically from about 10 to about 25, and often from about 15 to about 20.

The material of construction of the container 201 can vary. Exemplary preferred materials include metal, synthetic plastic materials, and cellulosic materials (e.g., cardboard). Polymeric materials that can be extruded and/or molded into desired shapes are typically utilized, such as polypropylene, polyethylene, polystyrene, polyamide, and the like. For example, plastic materials may be injection molded to form the container 201.

Exemplary preferred body portions 202 are those that incorporate polymeric materials such as those types of plastic-type materials commonly used for popular types of smokeless tobacco products. For example, exemplary body portions 202 may be formed from polymeric materials and comparable to the components and general structure of body portions of containers commercially available with CAMEL Snuff, GRIZZLY and KODIAK products that are marketed by American Snuff Company, LLC. Various metallic materials may additionally or alternatively be employed to form the body portion 202 of the container 201. Metallic body portions formed from metallic materials are available from J. L. Clark of Rockford, Ill., Crown Cork and Seal of Philadelphia, Pa., and Independent Can of Belcamp, Md. The metallic materials may include tinplate or tinplated steel in some embodiments.

In a preferred embodiment, the body portion 202 is formed from a polymeric material, whereas the cover 204 is formed from a metallic material such as, for example, aluminum or tinplate. Such a configuration may be advantageous in that it provides an aesthetically appealing appearance by using a metallic cover 204 (which is typically stamped), while also allowing the body portion 202 to be less expensively produced using, for example, an injection molding process. In this manner, a rib structure (as further described below) may be more easily and less expensively applied to the body portion 202 (e.g., via plastic injection molding instead of metallic stamping). Exemplary covers formed from metallic materials include those employed in commercially available CAMEL Snuff, GRIZZLY and KODIAK products that are marketed by American Snuff Company, LLC.

Further, in one embodiment the body portion 202 and/or the cover 204 may be formed from two or more materials. For example, in one embodiment the body portion 202 may comprise a plastic insert or a liner inside of a metal peripheral film. This body portion 202 may be combined with a metal cover 204 such that the container 201 appears to be all metal when the exterior thereof is viewed. Use of a plastic insert in a metal peripheral film is employed in CAMEL Snus, as marketed by R. J. Reynolds Tobacco Company, GRIZZLY moist tobacco products, as marketed by American Snuff Company, LLC, and MARLBORO snus, as marketed by Philip Morris.

An exemplary cover 204 can be manufactured from iron or steel, which can be plated with a thin layer of tin, and then overcoated with primers, epoxy lacquers, and the like. If desired, a thin layer of thermoplastic (e.g., polyethylene taraphalate or polypropylene) can be applied over epoxy lacquer coated tin plated steel. In another embodiment the cover 204 can be manufactured from polymeric materials, such as polymeric materials identical to those used to produce the body portion 202.

Accordingly, the container 201 may be formed from various materials including, for example, metal, cellulosic materials, and/or plastic. In some embodiments the container may optionally include a gasket configured to seal the connection between the cover 204 and the body portion 202 as disclosed, for example, in U.S. Pat. No. 8,458,996 to Bried et al. and U.S. Pat. No. 8,910,781 to Pipes et al., which are incorporated herein by reference in their entireties.

As illustrated in FIGS. 1 and 2, the package 200 may additionally include a valve assembly 254. The valve assembly 254 may be configured to affect an atmosphere within the internal space 212. Various embodiments of valve assemblies and the operation thereof are described in detail below.

The valve assembly 254 may be engaged with the container 201. As illustrated, in one embodiment the valve assembly 254 may be engaged with (e.g., coupled to or embedded within) the body portion 202 of the container 201. For example, in the illustrated embodiment the valve assembly 254 is engaged with the bottom wall 206 of the body portion 202. However, in another embodiment the valve assembly 254 may be additionally or alternatively engaged with (e.g., coupled to or embedded within) the side wall 208 of the body portion 202. Regardless, by coupling the valve assembly 254 to the body portion 202, the valve assembly may be in fluid communication with both the internal space 212 within the container 201 and an external environment surrounding the container. Accordingly, the valve assembly 254 may affect the atmosphere within the internal space 212 as described below.

As described below, various other embodiments of containers including a valve assembly are provided. These containers may include some or all of the features of the container described above. Accordingly, not all details with respect to the containers described below are repeated for brevity purposes. However, it should be understood that the description provided above may be applicable to the containers described below unless otherwise indicated herein.

FIG. 3 illustrates a perspective view of a package 300 according to an additional example embodiment of the present disclosure. As illustrated, the package 300 may include a container 301, which may include a body portion 302 and a cover 304 removably secured thereto. The cover 304 may include a top wall 328 and a peripheral flange 330.

As illustrated in FIG. 4, the body portion 302 may include a bottom wall 306 and a side wall 308 extending therefrom. Thereby, the peripheral flange 330 of the cover 304 may engage an upper portion 326 of the side wall 308 of the body portion 302. For example, the peripheral flange 330 of the cover 304 may engage the upper portion 326 of the side wall 308 via a snap-fit or an interference fit.

The body portion 302 may define an internal space 312, which may be accessible via an opening 356 when the cover 304 is removed therefrom. The internal space 312 of the body portion 302 may be configured to receive a tobacco-containing material 324, which may comprise any of the various tobacco-containing materials described herein. As illustrated, the cover 304 may be configured to engage the body portion 302 so as to cover the opening 356 and substantially enclose the internal space 312.

As further illustrated in FIGS. 3 and 4, the package 300 may additionally include a valve assembly 354. The valve assembly 354 may be configured to affect an atmosphere within the internal space 312. Various embodiments of valve assemblies and the operation thereof are described in detail below.

The valve assembly 354 may be engaged with the container 301. As illustrated, in one embodiment the valve assembly 354 may be engaged with the cover 304 of the container 301. For example, in the illustrated embodiment the valve assembly 354 is engaged with the top wall 328 of the cover 304. However, in another embodiment the valve assembly 354 may be additionally or alternatively engaged with the peripheral flange 330 of the cover 304. Regardless, by coupling the valve assembly 354 to the cover 304, the valve assembly may be in fluid communication with both the internal space 312 within the container 301 and an external environment surrounding the container. Accordingly, the valve assembly 354 may affect the atmosphere within the internal space 312 as described hereinafter.

FIG. 5 illustrates a perspective view of a package 400 according to an additional example embodiment of the present disclosure. As illustrated, the package 400 may include container 401, which may include a body portion 402 and a cover 404 removably secured thereto. The cover 404 may include a top wall 428 and a peripheral flange 430.

As illustrated in FIG. 6, the body portion 402 may include a bottom wall 406 and a side wall 408 extending therefrom. Thereby, the peripheral flange 430 of the cover 404 may engage an upper portion 426 of the side wall 408 of the body portion 402. For example, the peripheral flange 430 of the cover 404 may engage the upper portion 426 of the side wall 408 via a snap-fit or an interference fit.

The body portion 402 may define an internal space 412. The internal space 412 of the body portion 402 may be configured to receive a tobacco-containing material 424, which may comprise any of the various tobacco-containing materials described herein. As illustrated, the cover 404 may be configured to engage the body portion 402 so as to cover an opening 456 to the body portion and substantially enclose the internal space 412.

As further illustrated in FIG. 6, the package 400 may additionally include a barrier film 458. The barrier film 458 may be configured to cover the opening 456 to the body portion 402. In this regard, the barrier film 458 may be glued, adhered, or otherwise secured to a top edge 448 of the body portion 402 of the container 401. Thereby, the internal space 412 may be enclosed by the barrier film 458 and the body portion 402. By way of example, the barrier film 458 may comprise a foil or a film (e.g., a polymer film). The barrier film 458 may comprise any embodiment of material that is selected and configured to be substantially fluid-impervious so as to prevent the flow of fluids from the internal space 412 to an external environment. However, in one embodiment the barrier film 458 may be configured to allow for oxygen transmission (e.g., diffusion) therethrough into the internal space 412. In this regard, for example, the barrier film 458 may comprise a material configured for oxygen transmission, as described below in greater detail, which may be configured to maintain the freshness of the tobacco-containing material by supporting the health of aerobic microbes within the tobacco-containing material.

Further, the package 400 may additionally include a valve assembly 454. The valve assembly 454 may be configured to affect an atmosphere within the internal space 412. Various embodiments of valve assemblies and the operation thereof are described in detail below. As illustrated, in one embodiment the valve assembly 454 may be engaged with (e.g., coupled to, embedded within, or integrally formed with) the barrier film 458. With respect to the embodiment in which the valve assembly is integrally formed with the barrier film, in some embodiments the barrier film and the valve assembly may comprise a plurality of fluid-impervious layers, wherein one or more apertures are defined in the layers and allow flow therethrough, as described below in greater detail. In other words, the fluid-impervious layers of the barrier film may define the valve assembly proximate the aperture(s) extending therethrough.

By engaging the valve assembly 454 with the barrier film 458, the valve assembly may be in fluid communication with the internal space 412 within the container 401. Further, the container 401 may be configured such that the valve assembly 454 is additionally in fluid communication with an external environment surrounding the container. Accordingly, the valve assembly 454 may affect the atmosphere within the internal space 412 as described below.

In this regard, the barrier film 458 and the valve assembly 454 may separate the internal space 412 within the body portion 402 from a secondary space 460 within the cover 404. In other words, the internal space 412 may be defined between the barrier film 458 and the body portion 402. Further, the secondary space 460 may be defined between the barrier film 458 and the cover 404, when the cover is secured to the body portion 102.

In order to allow for fluid communication between the internal space 412 within the body portion 402 and the external environment, the secondary space 460 may be in fluid communication with the external environment. Thus, whereas the above-described valve assemblies 254, 354 (see, FIGS. 1-4) are directly in fluid communication with the external environment, the valve assembly 454 included in the container 401 illustrated in FIGS. 5-9 is indirectly in fluid communication with the external environment through the secondary space 460.

In this regard, in one embodiment the cover 404 may include one or more apertures 462 extending therethrough. The apertures 462 may thus allow for fluid communication between the secondary space 460 and the external environment surrounding the package 400. Accordingly, the internal space 412 within the body portion 402 may be in fluid communication with the external environment through the valve assembly 454, the secondary space 460, and the apertures 462.

Alternatively or additionally, the body portion 402 may include a rib structure 438, as illustrated in FIG. 7. The rib structure 438 may project from an outer peripheral surface 410 of the body portion 402 at the upper portion 426 of the side wall 408. In some embodiments, the rib structure 438 may be integrally formed with the side wall 408 of the body portion 402, such as, for example, when the body portion is formed by a plastic injection molding process. In other instances, the rib structure 438 may be a separate and discrete component secured or otherwise affixed to the side wall 408 with appropriate mechanical fasteners or adhesive (e.g., an epoxy adhesive).

As described below, the rib structure 438 may be configured to allow for venting of the secondary space 460, which indirectly allows for venting of the internal space 412 (see, e.g., FIG. 6). In this regard, the rib structure 438 may comprise a plurality of rib segments 440 arranged in spaced relation around the periphery of the side wall 408 of the body portion 402 (e.g., positioned circumferentially about the side wall of the body portion when the container 401 is cylindrical). Any number of the rib segments 440 may be provided in accordance with the present disclosure (e.g., often about 2 to about 20 rib segments, and frequently about 5 to about 15 rib segments), although a preferred embodiment includes about 8 to about 12 rib segments. Each rib segment 440 may include a rib wall 444 and a rib projection 446.

Exemplary dimensions for the rib projections 446 include heights in the range of about 0.05 millimeters to about 0.25 millimeters, and widths in the range of about 1 millimeter to about 1.5 millimeters. As used herein in reference to the rib projections 446, height refers to the major dimension of the rib projection that extends outwardly, away from the side wall 408. The rib projections 446 may be positioned below the top edge 448 of the side wall 408 in the range of about 1.5 millimeters to about 2.0 millimeters below the top edge.

Each rib segment 440 is separated from an adjacent rib segment by a vent channel 442. Exemplary dimensions for the vent channels 442 include heights in the range of about 6.9 millimeters to about 7.2 millimeters, and depths in the range of about 0.1 millimeters to about 0.2 millimeters. Various other details with respect to embodiments of rib structures are provided in U.S. Pat. Pub. No. 2012/0193265 to Patel et al. and U.S. Pat. Pub. No. 2015/0136618 to Patel et al., which are incorporated herein by reference.

The valve assembly 454 may allow venting of the internal space 412 into the secondary space 460 (see, FIG. 6). Further, when the cover 404 (see, e.g., FIG. 6) is engaged with the body portion 402, the vent channels 442 defined between the cover and the body portion 402 allow venting from secondary space 460 within the container 401 to the atmosphere exterior of the container. Accordingly, a flow path is provided from the internal space 412, through the valve assembly 454, through the secondary space 460, between the top edge 448 of the side wall 408 and the cover 404, and downwardly between the rib segments 440 through the vent channels 442 to a lip 450 of the body portion 402.

In this regard, FIG. 8 shows an enlarged cross-sectional view of an upper portion of the container 401 along line 8-8 from FIG. 5. As illustrated, the barrier film 458 may be separated from the top wall 428 of the cover 402 such that the secondary space 460 is in fluid communication with the rib structure 438. Thus, the secondary space 460 is in fluid communication with the vent channels 442 (see, FIG. 7).

In instances where the lip 450 is provided on the body portion 402, a lower edge 432 of the peripheral flange 430 may interact with the lip 450 to form a stop when the cover 404 is received upon the body portion 402. In other words, the lower edge 432 of the cover 404 may abut the lip 450 when the cover 404 is fully seated upon the body portion 402. Thereby, the cover 404 may be dimensioned such that when the lower edge 432 of the cover abuts the lip 450, a gap may be defined between the barrier film 458 and the top wall 428 of the cover to allow for venting from the secondary space 460 to the rib structure 438. In this embodiment the lip 450 and/or the lower edge 432 of the peripheral flange 430 may include channels, gaps, or other features configured to allow for venting from the vent channels 442 (see, FIG. 7) to the exterior environment around the container 401. Alternatively, the lip 450 may be separated from the lower edge 432 of the peripheral flange 430 when the cover 404 is fully received on the body portion 402 to allow for venting from the vent channels 442 to the exterior environment around the container 401 between the lip and the lower edge of the peripheral flange. In this embodiment a gap may still be defined between the barrier film 458 and the top wall 428 of the cover 404. For example, the rib structure 438 may interact with a channel or other structure at an inner surface 436 of the peripheral flange 430 of the cover 404 to maintain the top wall 428 at a position separated from the barrier film 458 to allow for venting. Alternatively, protrusions may extend from the bottom of the top wall 428 to engage the barrier film 458 and or the body portion 102 so as to allow for venting therebetween.

Accordingly, regardless of whether the container 401 includes one or more apertures 462 (see, e.g., FIG. 5) or the rib structure 438, the valve assembly 454 may vent the internal space 412. Thus, the environment within the internal space 412 of the container 401 may be controlled and/or affected so as to facilitate storage of the tobacco-containing material 424 therein. For example, usage of venting mechanisms such as the above-described rib structure 438 may allow for release of pressure from the container 401. Accordingly, issues with respect to the container 401 bulging or otherwise deforming or breaking as a result of gas buildup therein may be avoided. Further, venting may avoid issues with respect to the container releasing gas defining an undesirable odor at the time of opening the container.

Note that usage of the package 400 may be substantially similar to usage of the other packages described herein. In this regard, access to the tobacco-containing material 424 may involve removal of the cover 404, as illustrated in FIG. 9. However, usage of the container 401 may additionally include removal of the barrier film 458 (e.g., by peeling the barrier film away for the top edge 448 of the body portion 402), as further illustrated in FIG. 9. In some embodiments the barrier film 458 may be configured to be permanently removed. In this regard, removal of the barrier film 458 may occur only during the initial access to the internal space 412. However, in other embodiments the barrier film 458 may be configured to be resealable (e.g., with respect to the top edge 448 of the body portion 402). This embodiment may be desirable in that it allows for continued usage of the valve assembly 454 after the first opening of the container 401, whereas discarding the barrier film 458 would result in discarding the valve assembly. However, embodiments of the barrier film 458 in which the barrier film is configured for removal and disposal may not be of significant detriment in that repeated opening of the container 401 during usage may minimize the benefit of the valve assembly 454 during this time period.

In the above-described embodiments of packages the valve assembly is directly exposed to the internal space in which the tobacco-containing material is stored. Thus, depending on the orientation of the container, the valve assembly may be in direct contact with the tobacco-containing material. Accordingly, the valve assembly may be configured to resist becoming clogged or otherwise detrimentally affected by contact with the tobacco-containing material, regardless of whether the tobacco-containing material is in pouched or free form. Thus, for example, the valve assembly may include a screen or a plurality of inlet apertures proximate the internal space configured to resist clogging.

However, in other embodiments it may be desirable to separate the valve assembly from the tobacco-containing material. In this regard, FIG. 10 illustrates an embodiment of a package 200' that is substantially similar to the embodiment of the package 200 illustrated in FIGS. 1 and 2. However, the package 200' additionally includes a protective barrier 264 which separates the tobacco-containing material 224 from the valve assembly 254. The protective barrier 264 may be coupled to the side wall 208 and/or the bottom wall 206 of the body portion 202 in any of a variety of manners. The protective barrier 264 may allow for fluid communication in the manner described above due to inclusion of apertures 266 extending therethrough, wherein the apertures are configured to resist clogging by the tobacco-containing material 224 and/or movement of the tobacco-containing material therethrough due to the apertures defining an appropriately small size.

In some embodiments, as illustrated, the package 200' may additionally include an environment modification material 267, and the protective barrier 264 may comprise an intermediate wall. The environment modification material 267 may be positioned in a lower portion 269 of the internal space 212 defined between the protective barrier 264 and the bottom wall 206. The environment modification material 267 may be configured to affect the atmosphere within the internal space 212 and in particular within an upper portion 271 of the internal space in which the tobacco-containing material 224 is positioned. For example, the environment modification material 271 may be configured to control a humidity level in the internal space, affect gas levels therein, provide or remove scents, or perform other functions. Various other details with respect to environment modification materials and intermediate walls are provided in U.S. Pat. Pub. No. 2015/0136618 to Patel et al., which is incorporated herein by reference.

Similarly, FIG. 11 illustrates an embodiment of a package 300' that is substantially similar to the embodiment of the package 300 illustrated in FIGS. 3 and 4. However, the package 300' additionally includes a protective barrier 364 which separates the tobacco-containing material 324 from the valve assembly 354. The protective barrier 364 may be coupled to the top wall 328 or the peripheral flange 330 of the cover 304 in any of a variety of manners. The protective barrier 364 may allow for fluid communication in the manner described above due to inclusion of apertures 366 extending therethrough, wherein the apertures are configured to resist clogging by the tobacco-containing material 324 and/or movement of the tobacco-containing material therethrough due to the apertures defining an appropriately small size.

Additionally, FIG. 12 illustrates an embodiment of a package 400' that is substantially similar to the embodiment of the package 400 illustrated in FIGS. 5-9. However, the package 400' additionally includes a protective barrier 464 which separates the tobacco-containing material 424 from the valve assembly 454. The protective barrier 464 may be coupled to the barrier film 458 in any of a variety of manners. The protective barrier 464 may allow for fluid communication in the manner described above due to inclusion of apertures 466 extending therethrough, wherein the apertures are configured to resist clogging by the tobacco-containing material 424 and/or movement of the tobacco-containing material therethrough due to the apertures defining an appropriately small size.

FIG. 13 illustrates a container 501 according to an additional example embodiment of the present disclosure. As illustrated, the container 501 may include a body portion 502 and a cover 504 removably secured thereto. The body portion 502 may include a bottom wall 506 and a side wall 508 extending therefrom.

Further, the cover 504 may include a top wall 528 and a peripheral flange 530. Thereby, the peripheral flange 530 of the cover 504 may engage an upper portion 526 (see, FIG. 14) of the side wall 508 of the body portion 502. For example, the peripheral flange 530 of the cover 504 may engage the upper portion 526 of the side wall 508 via a snap-fit or an interference fit.

As illustrated in FIG. 14, the body portion 502 may define an internal space 512, which may be accessible via an opening 556 when the cover 504 is removed therefrom. The internal space 512 of the body portion 502 may be configured to receive a tobacco-containing material 524, which may comprise any of the various tobacco-containing materials described herein. As illustrated in FIG. 13, the cover 504 may be configured to engage the body portion 502 so as to cover the opening 556 (see, FIG. 14) and substantially enclose the internal space 512.

Additionally, the body portion 502 may include a rib structure 538, as illustrated in FIG. 14. The rib structure 538 may be substantially similar to the above-described rib structure 438 (see, e.g., FIG. 8). Accordingly, the rib structure 538 will be described briefly hereinafter. However, it should be understood that the disclosure provided above with regard to the rib structure 438 (see, e.g., FIG. 8) is applicable to the rib structure 538 illustrated in FIG. 14.

As illustrated in FIG. 14, the rib structure 538 may project from an outer peripheral surface 510 of the body portion 502 at the upper portion 526 of the side wall 508. As described below, the rib structure 538 may be configured to allow for venting of the internal space 512. In this regard, the rib structure 538 may comprise a plurality of rib segments 540 arranged in spaced relation around the periphery of the side wall 508 of the body portion 502. Each rib segment 540 is separated from an adjacent rib segment by a vent channel 542. Each rib segment 540 may include a rib wall 544 and a rib projection 546.

When the cover 504 is secured to the body portion 502, the vent channels 542 defined between the cover and the body portion allow venting from the internal space 512 to the atmosphere exterior of the container 501. Accordingly, a flow path is provided from the internal space 512, between a top edge 548 of the side wall 508 downwardly between the rib segments 540 through the vent channels 542 to a lip 550. In this regard, the top edge 548 may include protrusions 552 configured to separate the top wall 528 of the cover 504 (see, FIG. 13) from the top edge of the body portion 502 that allow for venting between the top edge 548 of the body portion 502 and the cover 504 and down through the vent channels 542. Accordingly, issues with respect to the container 501 bulging or otherwise deforming or breaking as a result of gas buildup therein may be avoided.

FIG. 15 illustrates a package 500 including the container 501 of FIGS. 13 and 14. The package 500 may include additional or alternative features configured to affect an atmosphere within the internal space 512 of the container 501. In this regard, as illustrated in FIG. 15, in one embodiment the package 500 may further comprise an overwrap or a peripheral film 568 enclosing the container 501 within an enclosed space 570. For example, the peripheral film 568 may comprise a foil or a film (e.g., a polymer film) that surrounds the container 501. The peripheral film 568 may comprise any embodiment of material that is selected and configured to be substantially fluid-impervious so as to prevent the flow of fluids from the enclosed space 570 to an external environment. However, in one embodiment the peripheral film 568 may be configured to allow for oxygen transmission (e.g., diffusion) therethrough into the enclosed space 570, which is in fluid communication with the internal space 512 (see, e.g., FIG. 13) within the container 501. In this regard, for example, the peripheral film 568 may comprise a material configured for oxygen transmission, as described below, which may be configured to maintain the freshness of the tobacco-containing material by supporting the health of aerobic microbes within the tobacco-containing material.

The package 500 may further comprise a valve assembly 554. The valve assembly 554 may be configured to affect an atmosphere within the internal space 512 (see, e.g., FIG. 13) within the container 501. However, whereas the previously-described embodiments of valve assemblies are directly in fluid communication with the internal spaces within the containers, the valve assembly 554 included in the package 500 is engaged with the peripheral film 568 that encloses the container 501. Thus, the valve assembly 554 is directly in fluid communication with the enclosed space 570, which is indirectly in fluid communication with the internal space 512 within the container 501. In particular, fluid that vents out of the internal space 512 through the vent channels 542 (see, e.g., FIG. 14) in the manner described above (or via any other vent feature such as apertures in the cover 504 or the body portion 502) may enter the enclosed space 570 within the peripheral film 568, and thereafter exit the enclosed space via the valve assembly 554.

The valve assembly 554 may be coupled to the peripheral film 568 in various manners. For example, the valve assembly may be secured to an inner surface or an outer surface of the peripheral film, and the peripheral film may define one or more apertures extending therethrough at a location at which the valve assembly is coupled to the peripheral film such that the valve assembly is in fluid communication with the external environment and the enclosed space. Alternatively, the valve assembly may be embedded within or integrally formed with the peripheral film. In some embodiments the valve assembly may comprise a plurality of fluid-impervious layers, as described below, such that the combination of the valve assembly and the peripheral film is relatively thin and unobtrusive. For example, the valve assembly may be integrally formed with the peripheral film, and the peripheral film and the valve assembly may comprise a plurality of fluid-impervious layers, wherein one or more apertures are defined in the layers and allow flow therethrough, as described below in greater detail. In other words, the fluid-impervious layers of the peripheral film may define the valve assembly proximate the aperture(s) extending therethrough. Further, in some embodiments one or both of the peripheral film and the valve assembly may be printed on (e.g., with a product identifier, a warning barrier film, or other information or graphics), which may further conceal the appearance of the valve assembly.

As illustrated in FIG. 15, in one embodiment the package 500 may include one container 501 therein. However, as may be understood, multiple containers may be included in a single package in other embodiments. For example, FIG. 16 illustrates an embodiment of a package 500' including first and second containers 501A, 501B, which may be substantially similar to the container 501 described above, enclosed within the peripheral film 568 to which the valve assembly 554 is attached. Accordingly, the valve assembly may affect the internal spaces within multiple containers in some embodiments, for example when the containers are sold or delivered to merchants or consumers in packs.

FIG. 17 illustrates a perspective view of a package 600 according to an additional example embodiment of the present disclosure. As illustrated, the package 600 may include a container 601, which may include a body portion 602 and a cover 604 removably secured thereto. The body portion 602 may include a bottom wall 606 and a side wall 608 extending therefrom.

FIG. 18 illustrates a sectional view through the package 600. As illustrated, the cover 604 may include a top wall 628 and a peripheral flange 630. The top wall 628 may be substantially planar. Further, the peripheral flange 630 may extend downwardly from the top wall 628. Thereby, the peripheral flange 630 of the cover 604 may engage an upper portion 626 of the side wall 608 of the body portion 602. For example, the peripheral flange 630 of the cover 604 may engage the upper portion 626 of the side wall 608 via a snap-fit or an interference fit.

The body portion 602 may define an internal space 612, which may be accessible via an opening 656. The internal space 612 of the body portion 602 may be configured to receive a tobacco-containing material 624, which may comprise any of the various tobacco-containing materials described herein. As illustrated, the cover 604 may be configured to engage the body portion 602 so as to cover the opening 656 and substantially enclose the internal space 612.

As further illustrated in FIGS. 17 and 18, the package 600 may additionally include a valve assembly 654. The valve assembly 654 may be engaged with the container 601. In this regard, the package 600 may further comprise a barrier film 672, and the valve assembly may be engaged therewith. The barrier film 672 may comprise a label, a sticker, an overlap, or any other layer of material configured to engage the container 601. The barrier film 672 may include an adhesive surface configured to engage the container 601.

Thus, as illustrated, in one embodiment the valve assembly 654 may be engaged with the body portion 602 of the container 601 via the barrier film 672. For example, in the illustrated embodiment the valve assembly 654 is engaged with the bottom wall 606 of the container 601 via the barrier film 672. However, in another embodiment the valve assembly may be additionally or alternatively engaged with the side wall of the container.

The valve assembly 654 may be configured to affect an atmosphere within the internal space 612. In this regard, the barrier film 672 may position the valve assembly 654 such that the valve assembly is in fluid communication with the internal space 612 within the container 601. For example, the container 601 may define an aperture 674, or multiple apertures, extending therethrough. In the illustrated embodiment the aperture 674 extends through the bottom wall 606 of the body portion 602 and the barrier film 672 is coupled to the bottom wall such that the valve assembly 654 extends over the aperture. Further, in some embodiments a secondary space 660 may be defined between the aperture 674 and the barrier film 672 and/or the valve assembly. For example, as illustrated, the bottom wall 606 may define an indentation 661 through which the aperture 674 extends, such that operation of the valve assembly 654 is not impeded by contact with the body portion 602. Thereby, the secondary space 660 may be in fluid communication with the internal space 612 via the aperture 674. Accordingly, the valve assembly 654 may be in fluid communication with both the internal space 612 within the container 601 and an external environment surrounding the container. Thus, the valve assembly 654 may affect the atmosphere within the internal space 612 as described hereinafter.

The valve assembly 654 may be coupled to the barrier film 672 in various manners. For example, the valve assembly may be secured to an inner surface or an outer surface of the barrier film, and the barrier film may define one or more apertures extending therethrough at a location at which the valve assembly is coupled to the barrier film such that the valve assembly is in fluid communication with the external environment and the atmosphere within the container. Alternatively, the valve assembly may be embedded within or integrally formed with the barrier film. In some embodiments the valve assembly may comprise a plurality of fluid-impervious layers, as described below, such that the combination of the valve assembly and the barrier film is relatively thin and unobtrusive. For example, the valve assembly may be integrally formed with the barrier film, and the barrier film and the valve assembly may comprise a plurality of fluid-impervious layers, wherein one or more apertures are defined in the layers and allow flow therethrough, as described below in greater detail. In other words, the fluid-impervious layers of the barrier film may define the valve assembly proximate the aperture(s) extending therethrough. Further, in some embodiments one or both of the barrier film and the valve assembly may be printed on (e.g., with a product identifier, a warning barrier film, or other information or graphics), which may further conceal the appearance of the valve assembly.

Accordingly, in some embodiments the container may include a barrier film that retains a valve assembly in proximity to one or more apertures defined in the container, and through which the valve assembly is in fluid communication with an internal space within the container. These apertures may be defined through the body portion of the container, as illustrated in FIG. 18. Alternatively, these apertures may be defined through the cover and the barrier film may be coupled to the cover such that the valve assembly is positioned in proximity thereto.

FIG. 19 illustrates a perspective view of an alternate embodiment of a package 700 according to an additional example embodiment of the present disclosure. As illustrated, the package 700 may include a container 701, which may include a body portion 702 and a cover 704 removably secured thereto. The cover 704 may include a top wall 728 and a peripheral flange 730. The top wall 728 may be substantially planar. Further, the peripheral flange 730 may extend downwardly from the top wall 728.

FIG. 20 illustrates a perspective view of the body portion 702. As illustrated, the body portion 702 may include a bottom wall 706 and a side wall 708 extending therefrom. The body portion 702 may define an internal space 712, which may be accessible via an opening 756 when the cover 704 is removed therefrom. The internal space 712 of the body portion 702 may be configured to receive a tobacco-containing material 724, which may comprise any of the various tobacco-containing materials described herein.

The body portion 702 may include a rib structure 738. The rib structure 738 may project from an outer peripheral surface 710 of the body portion 702 at an upper portion 726 of the side wall 708. As described below, the rib structure 738 may be configured to allow for venting of the internal space 712. In this regard, the rib structure 738 may comprise a plurality of rib segments 740 arranged in spaced relation around the periphery of the side wall 708 of the body portion 702 (e.g., positioned circumferentially about the side wall of the body portion when the container 701 is cylindrical). Each rib segment 740 may include a rib wall 744 and a rib projection 746 (see, e.g., FIG. 21). Each rib segment 740 is separated from an adjacent rib segment by a vent channel 742. Various other details with respect to embodiments of rib structures are provided in U.S. Pat. Pub. No. 2012/0193265 to Patel et al. and U.S. Pat. App. Ser. No. 2015/0136618 to Patel et al., which are incorporated herein by reference.

When the cover 704 (see, e.g., FIG. 19) is engaged with the body portion 702, the opening 756 is covered and the internal space 712 is substantially enclosed. However, the vent channels 742 allow venting from the internal space 712 within the container 701 (see, e.g., FIG. 19) to the atmosphere exterior of the container. Accordingly, a flow path is provided between a top edge 748 of the side wall 708 downwardly between the rib segments 740 through the vent channels 742 to a lip 750.

A plurality of bumps or protrusions 752 may be positioned on the top edge 748 of the body portion 702. Alternatively, protrusions may extend from the bottom of the top wall of the cover. Thereby, the protrusions 752 may separate the cover 704 (see, e.g., FIG. 19) from the top edge 748 of the body portion 702 such that air may flow therebetween and through the vent channels 742 as described above. Such vent channels 742 thereby allow for venting when the cover 704 (see, e.g., FIG. 19) is fully seated on the body portion 702.

FIG. 21 illustrates an enlarged cross-sectional view of an upper portion of the sealed container 701. As illustrated, in instances where the lip 750 is provided on the body portion 702, a lower edge 732 of the peripheral flange 730 may interact with the lip 750 to form a stop when the cover 704 is received upon the body portion 702. In one embodiment the lip 750 and the lower edge 732 of the peripheral flange 730 may be substantially planar. However, in some embodiments the lip 750 and/or the lower edge 732 of the peripheral flange 730 may include channels, gaps, or other features configured to allow for venting from the vent channels 742 to the exterior of the container 701. In this embodiment the cover 704 may be dimensioned such that when the lower edge 732 of the cover abuts the lip 750, a gap may be defined between the top edge 748 of the body portion 702 and the top wall 728 of the cover, such that usage of the protrusions 752 may not be required. Alternatively, the lip 750 may be separated from the lower edge 732 of the peripheral flange 730 when the cover 704 is fully received on the body portion 702 to allow for venting from the vent channels 742 to the exterior of the container 701 at an interface or joint 776 between the body portion and the cover.

As further illustrated in FIGS. 19 and 20, the package 700 may additionally include a valve assembly 754. The valve assembly 754 may be engaged with the container 701. In this regard, the package 700 may further comprise a barrier film 772, and the valve assembly 754 may be engaged therewith. The barrier film 772 may comprise a label, a sticker, an overlap, or any other layer of material configured to engage the container 701. Further, the valve assembly 754 and the barrier film 772 may be configured in any of the manners described above, for example, with respect to FIGS. 17 and 18. In one embodiment the barrier film 772 may extend across the joint 776 between the body portion 702 and the cover 704. In this regard, for example, the barrier film 772 may comprise a tamper indicator and/or moisture barrier, which must be torn or removed to open the container 701.

The valve assembly 754 may be coupled to the barrier film 772 in various manners. For example, the valve assembly may be secured to an inner surface or an outer surface of the barrier film, and the barrier film may define one or more apertures extending therethrough at a location at which the valve assembly is coupled to the barrier film such that the valve assembly is in fluid communication with the external environment and the atmosphere within the container. Alternatively, the valve assembly may be embedded within or integrally formed with the barrier film. In some embodiments the valve assembly may comprise a plurality of fluid-impervious layers, as described below, such that the combination of the valve assembly and the barrier film is relatively thin and unobtrusive. For example, the valve assembly may be integrally formed with the barrier film, and the barrier film and the valve assembly may comprise a plurality of fluid-impervious layers, wherein one or more apertures are defined in the layers and allow flow therethrough, as described below in greater detail. In other words, the fluid-impervious layers of the barrier film may define the valve assembly proximate the aperture(s) extending therethrough. Further, in some embodiments one or both of the barrier film and the valve assembly may be printed on (e.g., with a product identifier, a warning barrier film, or other information or graphics), which may further conceal the appearance of the valve assembly.

Accordingly, the valve assembly 754 may be in fluid communication with the internal space 712 within the container 701 and an external environment surrounding the container. In particular, the valve assembly 754 is in fluid communication with the internal space 712 via the joint 776 and the vent channels 742 (see, FIG. 20), as described above. Thus, the valve assembly 754 may affect the atmosphere within the internal space 712 as described hereinafter.

The containers described above are configured to operate in a variety of manners to store tobacco-containing materials therein. The containers include valve assemblies configured to allow for venting of the internal space therein. In particular, in the embodiments of containers illustrated in FIGS. 1-4, 10, and 11, the containers are sealed at the interface between the cover and the body portion and venting directly occurs through the valve assembly. In this regard, for example, a sealing member may be employed to seal the cover to the body portion so as to prevent fluid transfer through the interface therebetween. For example, the containers may include a sealing member as disclosed in U.S. Pat. No. 8,910,781 to Pipes et al., which is incorporated by reference herein in its entirety. However, in other embodiments the interface between the cover and the body portion may be sufficiently sealed so as to not include a sealing member.

Further, the containers illustrated in FIGS. 5-9 and 12 include a barrier film that is sealed to the body portion so as to seal shut the internal space. The valve assembly is engaged with (e.g., coupled to, or integral with) the barrier film. Thereby, venting of the internal space occurs through the valve assembly into a secondary space, then from the secondary space to the exterior environment.

The containers illustrated in FIGS. 13-16 are configured to allow venting of the internal space. However, a peripheral barrier encloses the container(s) such that the internal space of each container is restricted so as to be in direct fluid communication with an enclosed space within the peripheral film enclosing the container. The enclosed space, in turn, is in fluid communication with the exterior environment through the valve assembly engaged with (e.g., coupled to, or integral with) the peripheral film.

The containers illustrated in FIGS. 17-21 include a valve assembly engaged with (e.g., coupled to, or integral with) a barrier film. The barrier film covers an aperture or other venting structure defined by the container. Thereby, the valve assembly allows venting of the internal space.

Accordingly, in the embodiments of packages and containers illustrated in FIGS. 1-21, fluid transfer from the internal space therein to the exterior environment may be substantially restricted so as to occur only at the valve assembly (with the exception of selective fluid transfer occurring through the barrier film or the peripheral film as described elsewhere herein). In other words, fluid transfer from the internal space within the containers to the exterior environment occurs through, and is thereby controlled by, a valve assembly. Thus, fluid transfer between the internal space within the containers and the exterior environment may be restricted in one or more manners.

In this regard, as noted above, the valve assembly respectively included in packages of the present disclosure may be configured to perform various functions. By way of example, the valve assembly may be configured to relieve pressure from the atmosphere within the internal space of the container. Thus, the valve assembly may be configured to allow for escape of fluid (e.g., gas) from the internal space to the external environment. In this regard, microbial action within tobacco-containing materials may generate gases. In particular, microbial action within fermented tobacco-containing materials that have not undergone pasteurization (e.g., moist snuff) may produces gases. These gases may disrupt the integrity of a container in which the tobacco-containing material is stored, cause odors, and/or cause taste changes that may be unacceptable to a user of the tobacco-containing material when stored in a sealed container. Accordingly, the valve assembly may be configured to allow gas to escape the package.

By configuring the valve assembly in this manner, the valve assembly may provide gas venting and pressure release functionality similar to that of a container including venting features. However, the valve assembly may be configured to provide additional functionality. For example, the valve assembly may be configured to resist, limit, or prevent moisture outflow from the atmosphere within the internal space. In this regard, moisture loss associated with employing a venting structure without a valve assembly may dry out the tobacco-containing material and detrimentally affect the perceived freshness of the tobacco-containing material.

Thus, the valve assembly may be configurable between a closed configuration and an open configuration. In some embodiments the valve assembly may be configured to remain closed except when exposed to a pressure within the package equal to an opening pressure. At this time the valve assembly will momentarily open to release the pressure and return to the closed configuration. Accordingly, pressure and gas within the internal space may be released to vent the container. However, less moisture may be lost as compared to an open vent arrangement as a result of the valve assembly only momentarily opening to release the gas and pressure, as opposed to continuously remaining open, which may result in additional moisture loss.

In some embodiments the valve assembly may comprise a one-way valve configured to allow for flow of gas and pressure out of the container while preventing pressure and gas from entering the container. This configuration may allow for venting of the container in the manner described above. However, in another embodiment the valve assembly may be configured to allow one or more gases to enter the container from the external environment, and thus the valve assembly may comprise a two-way valve.

For example, in some embodiments the valve assembly may be configured to allow oxygen to enter the container. In this regard, allowing oxygen through the valve assembly may help maintain the freshness of the tobacco-containing material by supporting the health of aerobic microbes within the tobacco-containing material. In one embodiment the valve assembly may include one or more layers of material that allow for oxygen diffusion or other methods of transmission therethrough in order to allow oxygen into the container from the external embodiment, as described by way of example below. However, in another embodiment the valve assembly may me mechanically configured to allow ambient fluid entry into the container (which may contain oxygen, amongst other gases), in addition to, or alternatively from, allowing venting of fluid out of the container.

Various operational parameters of the valve assemblies may be tuned or particularly selected to cause the valve assemblies to operate in a desired manner. For example, the valve assemblies may be designed to define a desired opening pressure, water vapor transmission rate, and/or oxygen transmission rate. In this regard, the size and shape of the valve assemblies may be particularly selected to define desired flow rates therethrough. Further, the diameter of the opening(s) extending through the valve assemblies, the surface area defined by the valve assemblies, and various other characteristics thereof may be selected to define desired flow rates and cause operation in the manner described herein.

Thus, various embodiments of valve assemblies may be included in the packages of the present disclosure and configured to perform the above-described functions. In some embodiments the valve assembly may comprise a one-way valve, a check valve, a pressure relief valve, a pressure release valve, and/or a blow-off valve. In one embodiment the valve assembly may be selected from a group consisting of a spring valve, a ball valve, a diaphragm valve, and a valve comprising a plurality of fluid-impervious layers.

In this regard, an example embodiment of a spring valve is disclosed in U.S. Pat. No. 3,291,150 to Ricker, which is incorporated herein by reference in its entirety. Further, an example embodiment of a ball valve is disclosed in U.S. Pat. No. 2,470,372 to Roth, which is incorporated herein by reference in its entirety. An example embodiment of a diaphragm valve is disclosed in U.S. Pat. No. 2,854,996 to Hughes, which is incorporated herein by reference in its entirety. Example embodiments of valves comprising a plurality of fluid-impervious layers are disclosed in U.S. Pat. No. 7,490,623 to Rypstra and U.S. Pat. No. 8,636,034 to Hoffman et al., which are incorporated herein by reference in their entireties. Examples of commercially available valves comprising a plurality of fluid-impervious layers include the PV-15, PV-25-FV, PV-41, and PV-51 valves available from PLITEK of Des Plaines, Ill. and the FLEXIS coffee valve available from CCL Label of Framingham, Mass. These embodiments of valves generally include a plurality of layers of material wherein one or more apertures are defined in one or more of the layers and allow flow therethrough when certain conditions are met, such as when exposed to a pressure differential on opposing sides thereof). In particular, the apertures may be spaced from one another, such that when the layers contact one another, the valve is closed. However, when the layers separate from one another (e.g., when exposed to a pressure differential on opposing sides of the valve assembly), a flow path may be created extending between the layers and to the apertures. Some embodiments of valves comprising a plurality of fluid-impervious layers (e.g., those available from CCL Label) may include a lubricant (e.g., an oil, silicone oil, or other hydrophobic substance), which may improve sealing and movement of the layers relative to one other. However, other embodiments of valves comprising plurality of fluid-impervious layers (e.g., those available from PLITEK) may not require usage of a lubricant.

The valve assemblies may comprise any of a variety of materials including metals and plastics. As noted above, in some embodiments the valve assemblies may be directly in fluid communication with the internal space in which the tobacco-containing material is stored. In these embodiments the valve assembly may comprise materials that are generally recognized as safe (GRAS). Such materials may also be employed in any of the other portions of the packages that contact the tobacco-containing material in some embodiments.

The valve assembly, the barrier film, and the peripheral film may be configured to be impervious to some fluids while allowing movement of other fluids therethrough. Thus, for example, the valve assembly, the barrier film, and the peripheral film may be configured to prevent flow of water therethrough, while allowing for movement of oxygen therethrough. In this regard, by way of example, an embodiment of the valve comprising a plurality of fluid-impervious layers may include a polytetrafluoroethylene membrane available from Hangzhou Filter Equipment Co. of Hangzhou China, which is porous to allow oxygen entry but also hydrophobic to resist moisture loss. In other embodiments the fluid-impervious layers may comprise SIRA FLEX RESOLVE film as produced by Sirance Food Packaging of Telford, UK or BREATHEWAY film as produced by BreatheWay of Guadalupe, Calif., which may be configured to allow flow of oxygen and/or carbon dioxide therethrough while substantially resisting moisture loss therethrough, and in some embodiments the permeability thereof with respect to the above-mentioned fluids may change based on temperature.

Thus, the term fluid-impervious, as used herein, may reference embodiments of valve assemblies, barrier films, peripheral films, and components thereof that are selectively fluid-impervious. In other words, the term fluid-impervious may reference embodiments of valve assemblies, barrier films, and peripheral films that are configured to prevent the flow of one or more fluids therethrough, while being further configured to allow the flow of one or more other fluids therethrough. However, in other embodiments fluid-impervious valve assemblies, barrier films, and peripheral film may be configured to prevent the flow of all or substantially all fluids therethrough.

Further embodiments of containers according to the present disclosure may include additional or alternative features. Accordingly, it should be understood that the features of the containers of the present disclosure may or may not be combined in any of various manners. Thus, for example, the containers described below may or may not include a valve assembly as described elsewhere herein.

A container according to an additional embodiment includes a wood liner. The wood liner may be positioned at all or a portion of an internal or external surface of the container. For example, the wood liner may define a circular shape and line the inside of a cover and/or the bottom of a body portion of the container. In another embodiment the wood liner may define a tubular configuration and may line the side wall of a body portion of the container. In an additional embodiment the wood liner may line substantially the entirety of one or both of the interior of the body portion and the interior of the cover of the container. The wood liner may be coupled to the inside of the container via any of various methods including, for example, via press-fit, adhesive, sealant, or mechanical structures such as pins and screws.

The wood liner may provide the container with a desirable aesthetic appearance. Additionally, the wood liner may be configured to affect the sensory characteristics associated with the container and/or the material (e.g., a tobacco containing material) received therein. In this regard, in some embodiments the wood liner may comprise an aromatic wood such as Spanish cedar, cedar, pine, balsam, oak, pinion, fir, juniper, sandalwood, rose wood, Applewood, moon beam, etc. Aromatic woods may affect the flavor and/or smell of the material in the container. Further, in some embodiments the wood may comprise wood previously employed to store and/or age tobacco as described elsewhere herein. Additionally, the wood liner may comprise wood infused with flavor or aroma by virtue of the storage or ageing of other substances. For example, the wood liner may comprise wood from wine barrels, wood from spirits barrels (e.g., alcoholic beverage barrels), wood from spice barrels, wood from tea barrels, etc.

By way of example, FIG. 22 illustrates a perspective view of an alternate embodiment of a package 800 according to an additional example embodiment of the present disclosure wherein the package includes a wood liner as described below. As illustrated, the package 800 may include a container 801, which may include a body portion 802 and a cover 804 removably secured thereto. The body portion 802 may include a bottom wall 806 and a side wall 808 extending substantially at a right angle therefrom. The body portion 802 may define an internal space 812, which may be accessible via an opening 856 (see, FIG. 24) when the cover 804 is removed therefrom. The internal space 812 of the body portion 802 may be configured to receive a product 824. The product 824 may comprise any of the products described herein, including the various tobacco-containing materials described herein. In one embodiment the product may be selected from the group consisting of pharmaceutical products, smoking products, smokeless tobacco products, and consumable products. With respect to tobacco-containing materials, in one example embodiment the product 824 may comprise moist snuff.

The cover 804 may be configured to engage the body portion 802 so as to cover the opening 856 (see, FIG. 24) and substantially enclose the internal space 812. A perspective view of the cover 804 is illustrated in FIG. 23. As illustrated, the cover 804 may include a top wall 828 and a peripheral flange 830. The top wall 828 may be substantially planar. Further, the peripheral flange 830 may extend at substantially a right angle relative to the top wall 828 such that the peripheral flange extends downwardly therefrom when engaged with the body portion 802.

FIG. 24 illustrates a perspective view of the body portion 802. As illustrated, in some embodiments the body portion 802 may include a rib structure 838 projecting from an outer peripheral surface 810 of the body portion 802 at an upper portion 826 of the side wall 808. The rib structure 838 may include a plurality of rib segments 840 respectively including a rib wall 844 and a rib projection 846. Each rib segment 840 is separated from an adjacent rib segment by a vent channel 842. A plurality of bumps or protrusions 852 may be positioned at a top edge 848 of the body portion 802 and/or protrusions may extend from the bottom of the top wall of the cover 804. Thereby, the cover 804 may be spaced from the top edge 848 of the body portion 802 such that air may flow therebetween and through the vent channels 842 to allow for venting of the internal space 812 as described above. Various other details with respect to embodiments of rib structures are provided in U.S. Pat. Pub. Nos. 2012/0193265 and 2015/0136618, each to Patel et al., which are incorporated herein by reference.

Note, however, that the rib structure 838 and the corresponding vent channels 842 are optional and need not be included in all embodiments of the container 801. Further, although not illustrated, in some embodiments the package 800 may additionally or alternatively include a valve assembly as described elsewhere herein.

Regardless of whether or not the package 800 includes venting components, the container 801 may include a wood liner. The wood liner may be engaged with one or more of the surfaces of the container 801. Although any of the surfaces of the container 801 may include a wood liner coupled thereto, in a preferred embodiment one or more inner surfaces of the container may include a wood liner.

In this regard, as illustrated in FIG. 23, the cover 804 may define an inner surface 882A. The inner surface 882A of the cover 804 may be defined by the top wall 828 and the peripheral flange 830. Similarly, as illustrated in FIG. 24, the body portion 802 may define an inner surface 882B. The inner surface 882B of the body portion 802 may be defined by the bottom wall 806 and the side wall 808. Accordingly, the wood liner may be engaged with at least one of the inner surface 882A of the cover 804 and the inner surface 882B of the body portion 802. Further, the wood liner may be engaged with all or a portion of the inner surface 882A of the cover 804 and the inner surface 882B of the body portion 802.

By way of example, FIG. 23 illustrates an embodiment of the cover 804 including a wood liner 886A engaged with the top wall 828 thereof. Further, FIG. 24 illustrates an embodiment of the body portion 802 including a wood liner 886B engaged with the bottom wall 806 and the side wall 808 thereof. By providing the wood liner 886B at the bottom wall 806 and the side wall 808 of the body portion 802 and at the top wall 828 of the cover 804, the product 824 (see, FIG. 22) received in the container 801 may be substantially surrounded by the wood liners when the cover is engaged with the body portion. In this regard, the peripheral flange 830 of the cover 804 may extend outside of the side wall 808 of the body portion 802 when engaged therewith such that positioning of the wood liner at the peripheral flange may not be necessary in order to substantially entirely surround the product 824 (see, FIG. 22). However, as may be understood, the wood liner may be configured in other manners to substantially entirely surround the product depending on the particular configuration of the body portion and the cover of the container.

Configuring and positioning the wood liner such that the wood liner substantially entirely surrounds the product may provide benefits. In this regard, positioning the wood liner in this manner may provide an appearance that consumers find appealing. Further, substantially entirely surrounding the product may assist in affecting the sensory characteristics of the product. For example, in embodiments in which the wood liner comprises an aromatic wood, the wood liner may impart an aroma and/or flavor to the product. However, in other embodiments the wood liner may be provided at only a portion of the inner surfaces of the body portion and the cover. Example embodiments of aromatic woods that may be included in the wood liner include Spanish cedar, cedar, pine, balsam, oak, pinion, fir, juniper, sandalwood, rose wood, Applewood, moon beam, and wood previously employed to store tobacco. Various other embodiments of aromatic woods are described elsewhere herein. As noted above, in some embodiments the wood liner may comprise previously employed to store and/or age tobacco. By way of example, the wood liner may be formed from the wood material recycled from wooden boxes employed to store and age tobacco, and which are referred to as hogshead. As is additionally described above, the wood liner may comprise wood infused with flavor or aroma by virtue of the storage or ageing of other substances. For example, the wood liner may comprise wood from wine barrels, wood from spirits barrels (e.g., alcoholic beverage barrels), wood from spice barrels, wood from tea barrels, etc.

A sectional view through the container 801 is schematically illustrated in FIG. 25. The sectional view may be applicable to one or both of the body portion 802 and the cover 804. As illustrated, the container 801 may include a primary structural layer 888, which may correspond to one or more of the bottom wall 806 of the body portion 802, the side wall 808 of the body portion 802, the top wall 828 of the cover 804, and the peripheral flange 830 of the cover 804.

The primary structural layer 888 may comprise any of the various materials disclosed herein. For example, in some embodiments the primary structural layer 888 may comprise plastic, metal, or paper. In a preferred embodiment the primary structural layer 888 of the body portion 802 may comprise plastic and the primary structural layer of the cover 804 may comprise metal. Further, a wood liner 886 may be engaged with the primary structural layer 888. For example, as illustrated, the wood liner 886 may be engaged with an inner surface 882 of the primary structural layer 888, which may correspond with the inner surface 882A of the cover 804 (see, FIG. 23) or the inner surface 882B of the body portion 802 (see, FIG. 24). Thus, the wood liner 886 may correspond with either the wood liner 886A (see, FIG. 23) or the wood liner 886B (see, FIG. 24), depending on whether the primary structural layer 888 is part of the cover 804 or the body portion 802.

The wood liner 886 may be coupled to the primary structural layer 888 via of any of various mechanisms. For example, the wood liner 886 may be coupled to the inner surface 882 of the primary structural layer 888 via conductive bonding or induction bonding. Conductive bonding and induction bonding may be employed in embodiments of the container 801 in which one or both of the primary structural layer 888 and the wood liner 886 comprise an electrically conductive material and at least one of the primary structural layer and the wood liner comprises a material configured to melt and bond with the other layer when the electrically conductive material is heated. An example embodiment of methods and apparatuses for induction molding is disclosed in U.S. Pat. No. 5,793,024 to Matsen et al., which is incorporated herein by reference in its entirety.

In another embodiment, the wood liner 886 may be coupled to the primary structural layer 888 by in-mold labeling. In-mold labeling is conducted by simultaneously molding a product and coupling a label thereto. Accordingly, the primary structural layer 888 may be molded into the shape of the body portion 802 or the cover 804 while the wood liner 886 is simultaneously engaged therewith. For example, in some embodiments the body portion 802 and the cover 804 (see, e.g., FIG. 22) may be molded (e.g., blow molded, injection molded, or thermoformed), and the wood liner 886 may be coupled thereto via in-mold labelling. Thus, by way of further example, the primary structural layer 888 may comprise injection molded plastic. In this embodiment the wood liner 886 may comprise an in-molded label or a phenolic-backed veneer. An example embodiment of methods and apparatuses for in-mold labeling is disclosed in U.S. Pat. No. 8,557,161 to Mizukoshi, which is incorporated herein by reference.

In the embodiments of mechanisms and methods for engaging the wood liner 886 with the primary structural layer 888 disclosed above, the wood liner 886 may be directly coupled to the primary structural layer without usage of separate components or materials. However, in other embodiments other materials and/or components may be employed to engage the wood liner 886 with the primary structural layer 888. For example, as illustrated in FIG. 26, the wood liner 886 may be coupled to the inner surface 882 of the primary structural layer 888 via an adhesive 890. In a preferred embodiment the adhesive 890 may be approved by the Food and Drug Administration for usage in contact with food, to prevent contamination of the product 824 (see, FIG. 22).

In another embodiment various other mechanisms may be configured to retain the wood liner 886 in engagement with the inner surface 882 of the primary structural layer 888. For example, FIG. 27 schematically illustrates a sectional view of a corner of the container 801 at either the cover 804 or the body portion 802 (see, FIG. 22). For example, the corner may correspond to the intersection of the top wall 828 and the peripheral flange 828 of the cover 804 (see, e.g., FIG. 23) or correspond to the intersection of the side wall 808 and the bottom wall 806 of the body portion (see, e.g., FIG. 24). As illustrated, in some embodiments the container 801 may include an insert 892 configured to hold the wood liner 886 to the inner surface 882 of the primary structural layer 888. For example, the insert 892 may comprise a torsion spring that presses the wood liner 886 against the inner surface 882 of the primary structural layer 888. Thereby, wood liner 886 may be retained in engagement with the primary structural layer 888. However, as may be understood, various other embodiments of inserts may be employed to engage the wood liner 886 with the primary structural layer 888. In another example, a retainer (e.g., a plastic retainer) may be employed to engage the wood liner 886 with the primary structural layer 888. By way of further example, groves or slits may be built into any internal or external surface of the primary structural layer 888 to engage the wood liner 886 with the primary structural layer 888. Thus, for example, the wood liner 886 may be engaged with the primary structural layer 888 via interference fit.

In some embodiments the wood liner 886 may comprise a wood veneer. As schematically illustrated in FIG. 26, embodiments of the wood liner 886 comprising a wood veneer include a layer of thin slices of wood 894 that are glued or otherwise bonded together. As further illustrated in FIG. 25, some embodiments of the wood liner 886 comprising a wood veneer may further include a backing layer 896. Such embodiments may be referred to as a backed veneer. Examples of the backing layer 896 may include a paper backing, a fleece backing, a phenolic backing, a wood backing, etc. The backing layer 896 may be positioned at an attachment surface 898 of the wood liner 886 configured to engage the primary structural layer 888 (see, e.g., FIG. 25). For example, the backing layer may be engaged with the inner surface via induction bonding or conductive bonding as described elsewhere herein.

The backing layer 896 may provide the wood liner 886 with enhanced strength and/or facilitate attachment with the primary structural layer 888. However, in other embodiments the wood liner 886 may comprise a raw veneer, which refers to a wood veneer that does not include a backing layer. Usage of a raw veneer may simplify construction and/or reduce material costs. In this regard, the primary structural layer 888 may provide strength such that the wood liner 886 may not need to provide additional structural support.

Regardless of the particular components of the wood liner 886, the wood liner may define certain desirable characteristics. In particular, the wood liner 886 may be relatively smooth. Thereby, issues with respect to the wood liner producing splinters may be avoided.

A container according to an additional embodiment of the present disclosure includes a fibrous mat. The fibrous mat may comprise any adsorbent or absorbent material configured to retain moisture and/or flavorant. For example, the adsorbent material may comprise synthetic fibers, paper, tobacco, cellulose acetate, fiberglass, reconstituted tobacco, and/or any other adsorbent or absorbent material. One example embodiment of a material suitable for usage as the fibrous mat is AquaSense Labels, available from ESSENTRA PACKAGING. The fibrous mat may be positioned anywhere in the container (e.g., lining the cover or the body portion, or as an object within the container) and may define any shape (e.g., a packet, a pellet, or a thin layer).

In an additional embodiment a container includes a barrier film extending around an interface or joint between a cover and a base of a container. The barrier film may provide a moisture barrier and/or tamper indicator. The barrier film may be engaged with the container via an adhesive (e.g., pressure sensitive adhesive) or shrink wrapping. The barrier film may comprise, for example, paper or plastic, which may be punctured in order to open the container. However, it may be difficult for a user to puncture the barrier film, particularly in embodiments in which the barrier film comprises plastic.

Accordingly, in one embodiment the barrier film may be weakened at selected locations. For example, the barrier film may be scored with a plurality of holes or cuts extending at least partially therethrough. In one embodiment the barrier film may be scored with a laser. Thereby, the scored barrier film may be more easily punctured by a user (e.g., via a finger nail) so as to open the container. In one embodiment the scoring may extend along the joint between the cover and the body portion of the container. Thereby, the cover may be separated from the body portion without requiring removal of the barrier film from the container. This may be preferable in that the barrier film may comprise an adhesive, which may otherwise stick to a user's hands and/or remain on the container and bind contaminants thereto when the barrier film is removed.

As described above, the containers of the present disclosure may be configured to receive a product therein, which is generally described herein as comprising a tobacco-containing material, and which may be configured in a pouched form. However, in other embodiments various other products in addition to, or instead of, the tobacco-containing material may be received in the container. In one embodiment the tobacco-containing material and an additional product may be received within the container. Examples of additional products include a coupon (e.g., a folded paper coupon), a token, promotional literature, directions for product usage, a desiccant, a humectant, and a flavor supplying agent (e.g., a bead, ball, or sponge). The additional product may be wrapped in a wrapper (e.g., cellophane, paper, etc.), which may protect the additional product from the tobacco-containing material and vice versa.

In an additional aspect, a packaging method is provided. As illustrated in FIG. 29, the method may include providing a package at operation 902. The package may include a container comprising a cover and a body portion defining an internal space accessible via an opening. The container may additionally include a valve assembly configured to affect an atmosphere within the internal space. The method may further include inserting a tobacco-containing material through the opening into the internal space in the body portion at operation 904. Additionally, the method may include engaging the cover with the body portion so as to cover the opening and substantially enclose the internal space at operation 906.

In some embodiments the packaging method may further comprise positioning the valve assembly in fluid communication with the internal space and an external environment. In some embodiments positioning the valve assembly may include engaging the valve assembly with the cover of the container. In other embodiments positioning the valve assembly may include engaging the valve assembly with at least one of a side wall and a bottom wall of the body portion of the container. Further, positioning the valve assembly may include securing the valve assembly to the container with a barrier film.

The method may additionally include coupling a barrier film to the container. The valve assembly may be engaged with the barrier film. Coupling the barrier film to the container may comprise covering the opening to the body portion. Engaging the cover with the body portion at operation 906 may comprise defining a secondary space between the barrier film and the cover. The valve assembly may be configured to vent from the internal space into the secondary space. Engaging the cover with the body portion at operation 906 may further comprise defining one or more vent channels between the cover and the body portion. The vent channels may be configured to vent the secondary space to an external environment.

In another embodiment coupling the barrier film to the container may comprise positioning the barrier film over an aperture defined through the container. Coupling the barrier film to the container may further comprise defining a secondary space between the barrier film and the container. The secondary space may be in fluid communication with the internal space through the aperture and the valve assembly may be configured to vent from the secondary space to an external environment. In another embodiment coupling the barrier film to the container may comprise positioning the barrier film over a joint between the body portion and the cover of the container. Further, engaging the cover with the body portion at operation 606 may comprise defining one or more vent channels between the cover and the body portion. The valve assembly may be in fluid communication with the internal space through the vent channels.

Further, the method may include engaging the valve assembly with the barrier film such that the valve assembly is in fluid communication with the internal space and an external environment. The method may additionally include enclosing the cover and the body portion with a peripheral film. The method may further include engaging the valve assembly with the peripheral film such that the valve assembly is in fluid communication with the internal space and an external environment.

In an additional aspect a method for manufacturing a container is provided. As illustrated in FIG. 30, the method may include providing a body portion defining an internal space accessible via an opening at operation 1002. Further, the method may include providing a cover configured to engage the body portion so as to cover the opening and substantially enclose the internal space at operation 1004. The cover and the body portion may respectively define an inner surface. Further, the method may include engaging a wood liner with at least one of the inner surface of the cover and the inner surface of the body portion at operation 1006.

In some embodiments providing the body portion at operation 1102 may include injection molding the body portion. Engaging the wood liner with the inner surface of the body portion at operation 1006 may be conducted simultaneously with injection molding the body portion. Engaging the wood liner with the inner surface of the body portion at operation 1006 may comprise in-mold labeling.

In some embodiments engaging the wood liner with at least one of the inner surface of the cover and the inner surface of the body portion at operation 1006 may include coupling the wood liner to the inner surface via an adhesive. Engaging the wood liner with at least one of the inner surface of the cover and the inner surface of the body portion at operation 1006 may include bonding the wood liner to the inner surface (e.g., via induction bonding or conductive bonding). Engaging the wood liner with at least one of the inner surface of the cover and the inner surface of the body portion at operation 1006 may include engaging an insert with the wood liner.

In some embodiments the method may further include inserting a product through the opening into the internal space in the body portion. The product may be selected from the group consisting of pharmaceutical products, smoking products, smokeless tobacco products, and consumable products. Engaging the wood liner with at least one of the inner surface of the cover and the inner surface of the body portion at operation 1006 may include engaging a backing layer with the inner surface. Engaging the wood liner with at least one of the inner surface of the cover and the inner surface of the body portion comprises engaging a wood veneer with at least one of the inner surface of the cover and the inner surface of the body portion.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

What is claimed is:

1. A container, comprising:

a body portion defining an internal space accessible via an opening and configured to receive a product;

a cover configured to engage the body portion so as to cover the opening and substantially enclose the internal space, the cover and the body portion respectively defining an inner surface, the inner surface of the cover being defined by a top wall and a peripheral flange extending outside of the body portion in an engaged position, the peripheral flange extending downwardly from the top wall, such that the peripheral flange extends substantially perpendicularly relative to the top wall; and a wood liner comprising a wood veneer is engaged with the top wall of the cover and the inner surface of the body portion to substantially surround the product, the peripheral flange being devoid of the wood liner, wherein:

the wood liner comprises an in-molded label, the wood liner is coupled to the inner surface via an inductive or conductive bonding process, or an insert holds the wood liner to the inner surface.

2. The container of claim 1, wherein the body portion comprises an injection molded plastic.

3. The container of claim 1, wherein the wood liner is selected from a group consisting of Spanish cedar, cedar, pine, balsam, oak, pinion, fir, juniper, sandalwood, rose wood, Applewood, and moon beam.

4. The container of claim 1, wherein the wood liner comprises hogshead wood previously employed to store or age tobacco.

5. The container of claim 1, wherein the wood veneer comprises a backed veneer.

6. The container of claim 1, wherein the wood veneer comprises a raw veneer.

7. The container of claim 1, in combination with a plurality of units of a product received in the internal space.

8. The container of claim 7, wherein the product is selected from the group consisting of pharmaceutical products, smoking products, smokeless tobacco products, and consumable products.

* * * * *